US011040288B2

(12) United States Patent
Brister et al.

(10) Patent No.: US 11,040,288 B2
(45) Date of Patent: Jun. 22, 2021

(54) MULTI-DEGREE OF FREEDOM ELEVATOR RIDE SYSTEM

(71) Applicant: Universal City Studios LLC, Universal City, CA (US)

(72) Inventors: Michael Keith Brister, Winter Garden, FL (US); Lisa Marie Levy, Orlando, FL (US); Michael Joseph Tresaugue, Windermere, FL (US)

(73) Assignee: Universal City Studios LLC, Universal City, CA (US)

( * ) Notice: Subject to any disclaimer, the term of this patent is extended or adjusted under 35 U.S.C. 154(b) by 261 days.

(21) Appl. No.: 16/248,957

(22) Filed: Jan. 16, 2019

(65) Prior Publication Data

US 2020/0171396 A1 Jun. 4, 2020

Related U.S. Application Data

(60) Provisional application No. 62/773,005, filed on Nov. 29, 2018.

(51) Int. Cl.
*A63G 9/16* (2006.01)
*A63G 31/00* (2006.01)

(52) U.S. Cl.
CPC ..... *A63G 9/16* (2013.01); *A63G 31/00* (2013.01)

(58) Field of Classification Search
CPC ..... A63G 31/00; A63G 31/04; A63G 31/10; A63G 31/16; A63G 7/00
USPC ..... 472/2, 131, 130; 104/53
See application file for complete search history.

(56) References Cited

U.S. PATENT DOCUMENTS

| | | | |
|---|---|---|---|
| 3,333,713 | A | 8/1967 | Frido |
| 3,353,503 | A | 11/1967 | Pettit |
| 3,457,876 | A | 7/1969 | Holden |
| 3,847,085 | A | 11/1974 | Rypinski |
| 4,641,587 | A | 2/1987 | Dalliard |
| 4,666,362 | A | 5/1987 | Landsberger et al. |
| 4,883,184 | A | 11/1989 | Albus |
| 4,973,042 | A | 11/1990 | Klopf et al. |
| 5,431,246 | A | 7/1995 | Matherly |
| 6,189,455 | B1 | 2/2001 | Thompson |

(Continued)

FOREIGN PATENT DOCUMENTS

| | | |
|---|---|---|
| CN | 101858160 | 10/2010 |
| GB | 2305645 A | 4/1997 |
| KR | 20180002809 A | 1/2018 |

OTHER PUBLICATIONS

PCT/US2019/061996 Invitation to Pay Additional Fees dated Feb. 17, 2020.

(Continued)

*Primary Examiner* — Kien T Nguyen
(74) *Attorney, Agent, or Firm* — Fletcher Yoder, P.C.

(57) ABSTRACT

A ride system to control ride vehicle motion includes a carriage that receives and secures a ride vehicle. The ride system also includes a plurality of pulley systems drivingly coupled to the carriage. Each pulley system of the plurality of pulley systems include a pulley, a pulley cable engaged with the pulley and attached to a portion of the carriage, and a motor drivingly coupled to the pulley to drive pulley motion and pulley cable motion, and thereby cause the portion of the carriage to displace in accordance with the pulley motion and the pulley cable motion.

21 Claims, 16 Drawing Sheets

(56) References Cited

U.S. PATENT DOCUMENTS

| | | | | |
|---|---|---|---|---|
| 6,406,299 | B1 * | 6/2002 | Murao | B25J 9/104 434/29 |
| 6,511,381 | B1 | 1/2003 | Cochron | |
| 6,566,834 | B1 | 5/2003 | Albus et al. | |
| 6,648,102 | B2 | 11/2003 | Bostelman et al. | |
| 6,808,459 | B2 | 10/2004 | Checketts | |
| 7,624,684 | B2 | 12/2009 | Morris | |
| 8,147,344 | B2 | 4/2012 | Crawford et al. | |
| 9,011,259 | B2 * | 4/2015 | Schmidt | A63G 31/00 472/59 |
| 9,302,190 | B1 | 4/2016 | Jennings | |
| 9,303,421 | B1 | 4/2016 | Jennings | |
| 9,732,535 | B2 | 8/2017 | Jennings | |
| 2007/0113753 | A1 | 5/2007 | Meindl et al. | |
| 2013/0019771 | A1 | 1/2013 | Gmeinwieser et al. | |
| 2017/0050115 | A1 | 2/2017 | Davis | |

OTHER PUBLICATIONS

Tadokoro, Satoshi, et al., "A Motion Base with 6-DOF by Parallel Cable Drive Architecture," IEEE/ASME Transactions on Mechatronics, vol. 7, No. 2, Jun. 2002, pp. 115-123.

MathWorks, "Creating a Stewart Platform Model Using Simmechanics," from https://www.mathworks.com/company/newsletters/articles/creating-a-stewart-platform-model-using-simmechanics.html?s_tid=srchtitle, 2002.

* cited by examiner

MULTI-DEGREE OF FREEDOM ELEVATOR RIDE SYSTEM

CROSS REFERENCE TO RELATED APPLICATIONS

This application claims priority to and the benefit of U.S. Provisional Patent Application No. 62/773,005, entitled "Multi-Degree of Freedom Elevator Ride System," filed Nov. 29, 2018, which is hereby incorporated by reference in its entirety for all purposes.

BACKGROUND

The present disclosure relates generally to amusement park-style rides, and more specifically to systems for controlling motion of a ride vehicle of the amusement park-style rides via a multi-degree-of-freedom (DOF) elevator ride system.

Generally, amusement park-style rides include ride vehicles that carry passengers along a ride path, for example, defined by a track. Over the course of the ride, the ride path may include a number of features, including tunnels, turns, ups, downs, loops, and so forth. The direction of travel of the ride vehicle may be defined by the ride path, as rollers of the ride vehicle may contact the tracks or other features defining the ride path. In this manner, traditional amusement park-style rides employing only tracks to define the ride path may limit the overall thrill and excitement experienced by passengers. Furthermore, controlling vertical motion (e.g., motion having a component oriented substantially parallel to the gravity vector) of the ride vehicle may be unfeasible for these amusement park-style rides employing only tracks. For instance, vertical motion of the ride vehicle may subject the tracks and components of the ride vehicle in contact with these tracks to undesirable conditions, such as unwanted loads, while performing this vertical motion. Accordingly, while it may be desirable to control vertical motion of a ride vehicle in such a manner that the ride experience is enhanced, in certain existing motion-based amusement park-style rides control of this vertical motion may be unfeasible and not thrilling, the improvement of which may be difficult to coordinate and implement in practice.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In an embodiment, a ride system to control ride vehicle motion includes a carriage that receives and secures a ride vehicle. The ride system also includes a plurality of pulley systems drivingly coupled to the carriage. Each pulley system of the plurality of pulley systems include a pulley, a pulley cable engaged with the pulley and attached to a portion of the carriage, and a motor drivingly coupled to the pulley to drive pulley motion and pulley cable motion, and thereby cause the portion of the carriage to displace in accordance with the pulley motion and the pulley cable motion.

In another embodiment, a method includes instructing, via a controller, a securing mechanism on a platform assembly to disengage from a carriage to enable a carriage housing a ride vehicle received from a first ride path to freely move relative to the platform assembly. The method further includes actuating, via the controller, a plurality of pulley systems to control carriage motion relative to the platform assembly. Furthermore, the method includes instructing, via the controller, a motor of the platform assembly to vertically transport the platform assembly from a first position coupled to the first ride path to a second position coupled to a second ride path, such that the platform assembly further defines the first ride path while in the first position, and the platform assembly further defines the second ride path while in the second position. The method also includes actuating, via the controller, the plurality of pulley systems to position the carriage on the platform assembly to enable the ride vehicle to travel along the second ride path.

In yet another embodiment, a ride system includes a platform assembly that includes a platform base that extends along a ride path, such that the platform base includes one or more alignment pins that mate with corresponding openings on a carriage to removably couple the carriage to the platform base. The carriage houses and secures a ride vehicle. The ride system also includes a pulley cable drivingly coupled to the platform assembly and a motor coupled to the pulley cable. The motor vertically transports the platform assembly from a first position associated with a first ride path to a second position associated with a second ride path by driving pulley cable motion of the pulley cable. The platform assembly further defines the first ride path while in the first position, and the platform assembly further defines the second ride path while in the second position.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
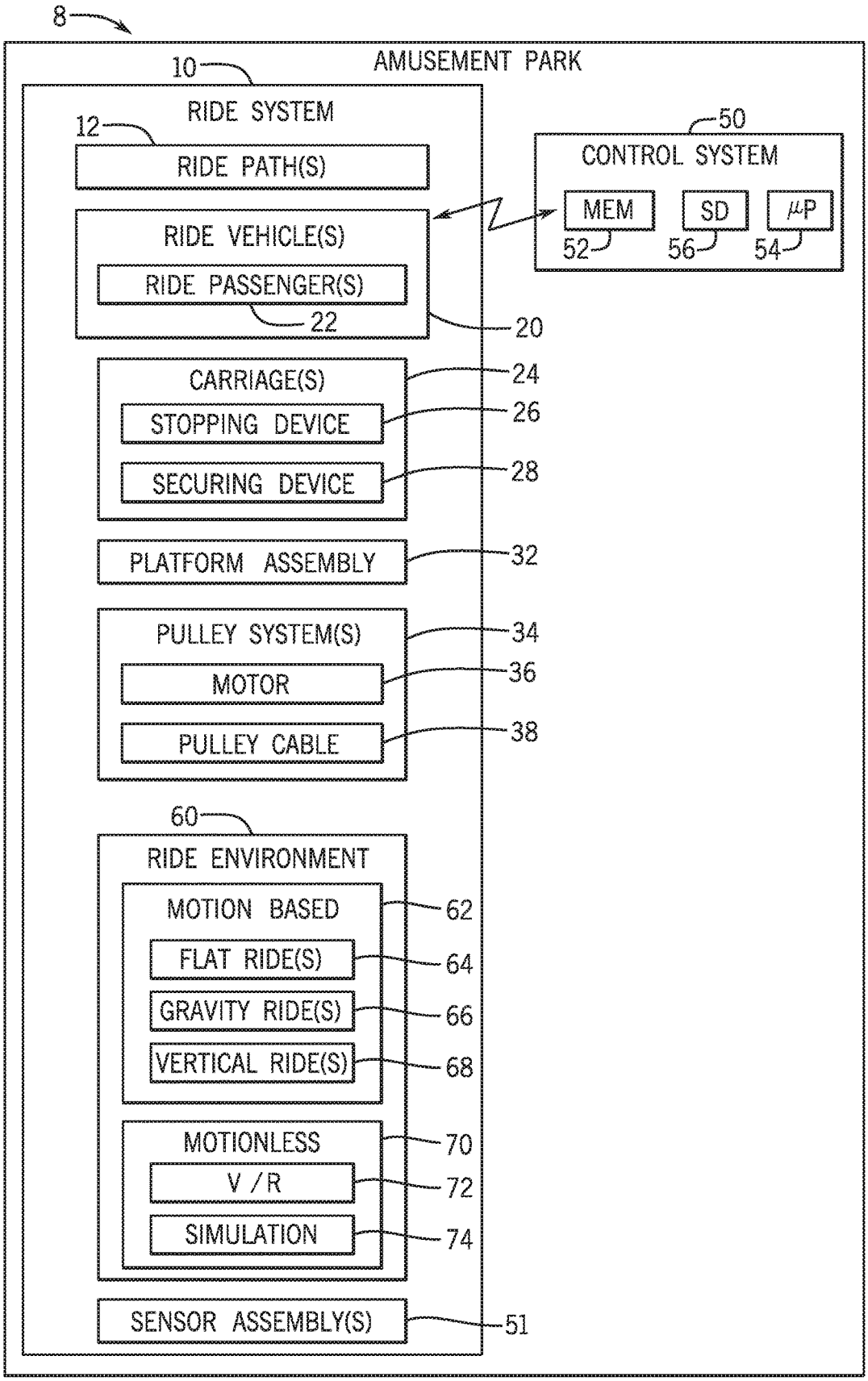
FIG. 1 is a block diagram of an embodiment of various components of an amusement park, in accordance with aspects of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

While the following discussion is generally provided in the context of amusement park-style rides that may include a plurality of closed-loop or open-loop pulley systems to drive motion of a carriage which may secure and house a ride vehicle, it should be understood that the embodiments disclosed herein are not limited to such entertainment contexts. Indeed, the provision of examples and explanations in such an entertainment application is to facilitate explanation by providing instances of real-world implementations and applications. As such, it should be appreciated that the embodiments disclosed herein may be useful in other applications, such as transportation systems (e.g., train systems, building and floor connecting systems), elevator systems, and/or other industrial, commercial, and/or recreational human transportation systems, to name a few.

With the forgoing in mind, present embodiments include systems and methods for controlling motion of a ride vehicle operating within a ride system. For example, ride systems, such as the above-referenced amusement park-style ride, may include one or more ride vehicles that carry passengers along a ride path, for example, defined by a track. Over the course of the ride, the ride path may include a number of features, including tunnels, turns, ups, downs, loops, and so forth. The direction of travel of the ride vehicle may be defined by the ride path, for example, as rollers of the ride vehicle may be in constant contact with the tracks defining the ride path. It may be desirable to control vertical motion of the ride vehicle along a vertical axis. "Vertical motion," as used to herein, may refer to motion having a component substantially oriented parallel to the gravity vector. In certain existing approaches in which roller assemblies of a ride vehicle are the sole mechanisms for driving motion of the ride vehicle along the tracks defining the ride path, such that the ride path has a component oriented along the vertical axis, vertical motion may result in unwanted loads experienced by the ride vehicle and/or the rollers assemblies. Furthermore, these existing approaches may result in the passenger always being oriented in the same direction relative to the ride path, which may be unwanted, as more complete control of the position and velocity of the passengers relative to the ride path may be desirable. Furthermore, in these existing approaches, the passenger may be aware that the vertical motion is realized via the ride vehicle continuing to traverse along the ride path, such that the thrill associated with the ride experience is compromised, as the passenger visually anticipates motion of the ride vehicle.

In accordance with certain embodiments of systems and methods disclosed herein, the ride experience may be enhanced as vertical motion of the ride vehicle is controlled. By way of example, the mechanisms allowing vertical motion are hidden from the passenger, and unwanted loads on the ride vehicle are reduced and/or eliminated. Aspects of the disclosed embodiments include receiving the ride vehicle from a ride path and securing the ride vehicle onto a carriage removably coupled to a platform assembly, as described in detail below. In an embodiment, the carriage may seamlessly mate with the ride path (e.g., tracks of the ride path) to seamlessly receive and then secure the ride vehicle. Furthermore, after securely housing the ride vehicle, the carriage (which houses the ride vehicle) may detach from the platform, such that the carriage is freely suspended relative to the platform, as discussed in detail below. In an embodiment, the platform may retract, pivot about a point, or execute any suitable motion, for example, so as to not interfere with motion of the carriage.

To allow for control over this motion of the carriage, the ride system may include a plurality of pulley systems each including an actuatable motor to drive motion of a corresponding pulley coupled to the ride vehicle to, in turn, collectively drive motion of the carriage. That is, a control system may receive ride system data (e.g., position, velocity, acceleration along or about any of a longitudinal, lateral, and vertical axis for the moveable features of the ride system) and actuate the motors to drive motion of the carriage, as described in detail below. The pulley systems may be open-loop or closed-loop control systems. "Open-loop" pulley systems may refer to pulley systems employing pulley cables having a first end separate from the second end. For example, a first end may couple to the carriage, while a second end may couple to a winch or wall. Furthermore, "closed-loop" pulley systems may refer to pulley systems employing pulley cables having a closed contour.

For pulley systems employing closed-loop pulley cables, the carriage may always contact the same points on the closed-loop pulley cables. In this manner, actuating a motor to drive the corresponding closed-loop pulley cable in rotation causes the carriage to be driven in motion, as motion of the carriage may be based on motion of the closed-loop pulley cable. For example, the carriage may be coupled to four pulleys that each pass through the carriage (e.g., an inner surface of the carriage) and include a portion oriented substantially parallel to one another and oriented along the vertical axis. As a result, a control instruction (e.g., control signal) from the control system that actuates the motor to drive the motion of the pulley cables may also control motion of the carriage.

To help illustrate, FIG. 1 is a block diagram of an embodiment of various components of an amusement park 8, in accordance with aspects of the present disclosure. The amusement park 8 may include a ride system 10, which includes a ride path 12 that receives and guides a ride vehicle 20, for example, by engaging with tires or rollers of the ride vehicle 20, and facilitates movement of the ride vehicle 20 (e.g., through an attraction). In this manner, the ride path 12 may define a trajectory and direction of travel that may include turns, inclines, declines, ups, downs, banks, loops, and the like. In an embodiment, the ride vehicle 20 may be passively driven or actively driven via a pneumatic system, a motor system, a tire drive system, a roller system, fins coupled to an electromagnetic drive system, a catapult system, and the like.

The ride path 12 may receive more than one ride vehicle 20. The ride vehicles 20 may be separate from one another, such that they are independently controlled, or the ride vehicles 20 may be coupled to one another via any suitable linkage, such that motion of the ride vehicles 20 is coupled or linked. For example, the front of one ride vehicle 20 may be coupled to a rear end of another ride vehicle 20. Each ride vehicle 20 in these and other configurations may hold one or more passengers 22. In an embodiment, the ride vehicle 20 may include a turntable, a yaw drive system, or any experience-enhancing motion-based platform allowing motion of a cab housing the passenger relative to a chassis of the ride vehicle 20.

The ride system 10 may include a carriage 24 that may receive one or more ride vehicles 20. In one non-limiting embodiment, the shape of the carriage 24 may substantially match the shape of the ride vehicle 20 to facilitate receiving and securing the ride vehicle 20. For example, the ride vehicle 20 may have a substantially rectangular prism contour, and the carriage 24 may have a similar substantially rectangular prism contour larger in size to receive and house the ride vehicle 20. While the shape of the ride vehicle 20 and carriage 24 is discussed as having a substantially rectangular prism contour, it should be understood that the ride vehicle 20 and the carriage 24 may individually be of any other suitable shapes and sizes.

The ride vehicle 20 may be driven in motion along the ride path 12 via rollers of a roller system, and the carriage 24 may seamlessly mate with the ride path 12 to receive the rollers. In this manner, the carriage 24 may further define the ride path 12 when mated. The passenger may not feel or experience substantial vertical displacements resulting from the ride vehicle 20 transitioning from the ride path 12 (e.g., tracks defining the ride path 12) to the carriage 24, as the ride rollers may seamlessly transition from the ride path 12 to the carriage 24. While certain embodiments of the ride path 12 are disclosed as having tracks, it should be understood that the tracks may be omitted, such that the ride path 12 may include a surface on which ride vehicles 20 (e.g., autonomous ride vehicles) may traverse.

To facilitate this seamless transition, the carriage 24 may include a stopping device 26 that decelerates the ride vehicle 20 and may include a securing device 28 that secures the ride vehicle 20 to the carriage 24 after the ride vehicle 20 decelerates to a stop. In an embodiment, the securing device 28 may include or also function as the stopping device 26, such that the securing device 28 is integral with the stopping device 26. The stopping device 26 may include a dead end stopping pin, a damper, a spring system, a break pad system, and/or any suitable device configured to decelerate the ride vehicle 20 onto a target position on the carriage 24. The securing device 28 may include a hook, a ratchet system, a redundant locking mechanism, or any suitable device to lock the ride vehicle 20 in place, allowing the ride vehicle 20 to become fixed relative to the carriage 24 at the target position on carriage 24. As may be appreciated, when the securing device 28 (and the stopping device 26) is engaged, the ride vehicle 20 may be fixed relative to the carriage 24. Alternatively, when the securing device 28 (and the stopping device 26) is disengaged, the ride vehicle 20 may freely egress from (or ingress into) the carriage 24. For example, the ride vehicle 20 may egress from the carriage 24 to continue traveling along the ride path 12. As discussed in detail below, the ride path to which the ride vehicle 20 egresses to may or may not be the same as the ride path from which the ride vehicle 20 is received from by the carriage 24.

The carriage 24 may be supported by a platform assembly 32 when the carriage 24 receives the ride vehicle 20. The carriage 24 may be removably coupled to the platform assembly 32, such that the carriage 24 may decouple from the platform assembly 32 to move relative to the platform assembly 32, as described in detail below. In an embodiment, the carriage 24 may detach from the platform assembly 32 after verification that the securing device 28 (and/or the stopping device 26) is engaged and/or after verification that the ride vehicle 20 is secured to the carriage 24. Verification of engagement of the securing device 28 and/or the stopping device 26 is described in further detail below. In an embodiment, motion of the carriage 24 may occur in response to verification that the ride vehicle 20 is secured to the carriage 24. In this manner, the ride vehicle 20 (which is secured and housed by the carriage 24) and the carriage 24 may collectively move as a single object (e.g., as a multi-DOF elevator).

Motion of the carriage 24 and the ride vehicle 20 may be realized via one or more pulley systems 34. For example, the pulley systems 34 may each include a motor 36 that may drive motion of a pulley cable 38. Furthermore, the pulley systems 34 may couple to the carriage 24 in any suitable configuration. In an embodiment, four pulley systems 34 may each include pulley cables 38 positioned parallel to one another and coupled to an inner surface of the carriage 24, such that the pulley cables 38 may be independently driven by a corresponding motor 36. While motion of the carriage as discussed in this example is realized via four pulley systems 34, it should be understood that any suitable number of pulley systems 34, such as one, two, three, five, ten pulley systems may be employed to control motion of the carriage. The pulley systems 34 may be in any suitable configuration and include open-loop or closed-loop cables.

The motors 36 may include any suitable motion-driving device such as a torque motor, a permanent magnetic direct current (DC) motor, an electrically excited motor, any universal alternating current (AC)-DC motor, or any suitable electromechanical actuators (e.g., linear actuators, rotary actuators, or pneumatic actuators). To facilitate control of the motor 36, the motor 36 may employ a permanent magnet, a servomechanism, and the like. In an embodiment, the motor 36 may include a relay or a contactor connected to one or more sensor assemblies 51 to automatically start or start in response to control instructions. The motor 36 may employ fuses or circuit breakers to attenuate any current received by the motor. The motors 36 may be hidden from the passengers 22, such that the motion driving mechanisms of the ride system 10 remain undetected by the passengers 22.

The pulley cable 38 may include a cable wire of any suitable characteristics and material. For example, the pulley cable 38 may include a steel cable having redundant features, such as a fiber core and an independent wire core. While the pulley cable 38 may be replaced or enhanced by a chain, employing a pulley cable 38 may result in a variety of benefits. For example, the pulley cable may be more light weight, require less maintenance, and operate more quietly than a chain.

The amusement park 8 may include a control system 50 that is communicatively coupled (e.g., via wired or wireless features) to the ride vehicle 20 and the features associated with the ride system 10. In an embodiment, the amusement park 8 may include more than one control system 50. For example, the amusement park 8 may include one control system 50 associated with the ride vehicle 20, another control system 50 associated with the carriage 24 and the pulley system 34, respectively, a base station control system 50, and the like. Further, each of the control systems 50 may be communicatively coupled to one another (e.g., via respective transceiver or wired connections).

The control system 50 may be communicatively coupled to one or more ride vehicle(s) 20 of the amusement park 8 via any suitable wired and/or wireless connection (e.g., via transceivers). The control system 50 may control various aspects of the ride system 10, such as the direction of travel of the ride vehicle 20 in some portions of the ride, by controlling the position of the carriage 24 by actuating the motors 36 to drive motion of the pulley cables 38. The control system 50 may receive data from sensor assemblies 51 associated with the ride system 10 to, for example, control the position and velocity of each of the pulley cables 38. In an embodiment, the control system 50 may be an electronic controller having electrical circuitry configured to process data associated with the ride system 10, for example, from the sensor assemblies 51 via transceivers. Furthermore, the control system 50 may be coupled to various components of the amusement park 8 (e.g., park attractions, park controllers, and wireless networks).

The control system 50 may include memory circuitry 52 and processing circuitry 54, such as a microprocessor. The control system 50 may also include one or more storage devices 56 and/or other suitable components. The processing circuitry 54 may be used to execute software, such as software stored on the memory circuitry 52 for controlling the ride vehicle(s) 20 and any components associated with the ride vehicle 20 (e.g., the carriage 24, the stopping device 26, the securing device 28, the platform assembly 32, and the pulley system 34). Moreover, the processing circuitry 54 may include multiple microprocessors, one or more "general-purpose" microprocessors, one or more special-purpose microprocessors, and/or one or more application specific integrated circuits (ASICS), or some combination thereof. For example, the processing circuitry 54 may include one or more reduced instruction set (RISC) processors.

The memory circuitry 52 may include a volatile memory, such as random-access memory (RAM), and/or a nonvolatile memory, such as read-only memory (ROM). The memory circuitry 52 may store a variety of information and may be used for various purposes. For example, the memory circuitry 52 may store processor-executable instructions (e.g., firmware or software) for the processing circuitry 54 to execute, such as instructions for controlling components of the ride system 10. For example, the instructions may cause the processing circuitry 54 to control motion of the carriage 24 by actuating motors 36 to drive motion of the pulley cables 38 to subject the passengers 22 to ride-enhancing motions, while also controlling a turntable or yaw drive system to further enhance the overall ride experience by subjecting the passenger to additional motion.

The storage device(s) 56 (e.g., nonvolatile storage) may include ROM, flash memory, a hard drive, or any other suitable optical, magnetic, or solid-state storage medium, or a combination thereof. The storage device(s) 56 may store ride system data (e.g., passenger information, data associated with the amusement park 8, data associated with a ride path trajectory), instructions (e.g., software or firmware for controlling the carriage 24, the platform assembly 32, the pulley system 34, and/or the ride vehicle 20), and any other suitable information.

The ride system 10 may additionally or alternatively include a ride environment 60, which may include multiple and differing combinations of environments. The ride environment 60 may include the type of ride (e.g., dark ride, water coaster, roller coaster, virtual reality [VR] experience, or any combination thereof) and/or associated characteristics (e.g., theming) of the type of ride. For example, the ride environment 60 may include aspects of the ride system 10 that add to the overall theming and/or experience associated with the ride system 10.

The ride system 10 may additionally or alternatively include a motion-based environment 62, in which the passengers 22 are transported or moved by the ride system 10. For example, the motion-based environment 62 may include a flat ride 64 (e.g., a ride that moves passengers 22 substantially within a plane that is generally aligned with the ground, such as by the ride vehicle 20 traveling along the ride path 12 toward the carriage 24). Additionally or alternatively, the motion based ride environment 62 may include a gravity ride 66 (e.g., a ride where motion of the passengers 22 has at least a component along the gravity vector, such as the motion generated via the pulley system 34 acting on the carriage 24). Additionally or alternatively, the motion based ride environment 62 may include a vertical ride 68 (e.g., a ride that displaces passengers 22 in a vertical plane around a fixed point, such as the motion generated via the pulley system 34 acting on the carriage 24).

The ride system 10 may additionally or alternatively include a motionless environment 70, in which the passengers 22 are not substantially transported or displaced by the ride system 10. For example, the motionless environment 70 may include a virtual reality (V/R) feature 72 (e.g., the passenger 22 may sit in a seat that vibrates or remains stationary while wearing a virtual reality (V/R) headset displaying a VR environment or experience) and/or a different kind of simulation 74. In an embodiment, the ride vehicle 20 may come to a stop along the ride path 12, such that the ride experience may include aspects of the motionless ride environment 70 for a portion of the duration of the ride experience. While the motionless environment 70 may not substantially move the passengers 22, virtual reality and/or simulation effects may modify the perception of the passengers 22, which may be enhanced and contrasted by motion-based distortion experienced by passengers 22. To that end, it should be understood the ride system 10 may include both motion-based and motionless ride environments 62 and 70, which make the carriage 24 and the pulley system 34 desirable features, at least for enhancing the ride experience.

Figure 2:
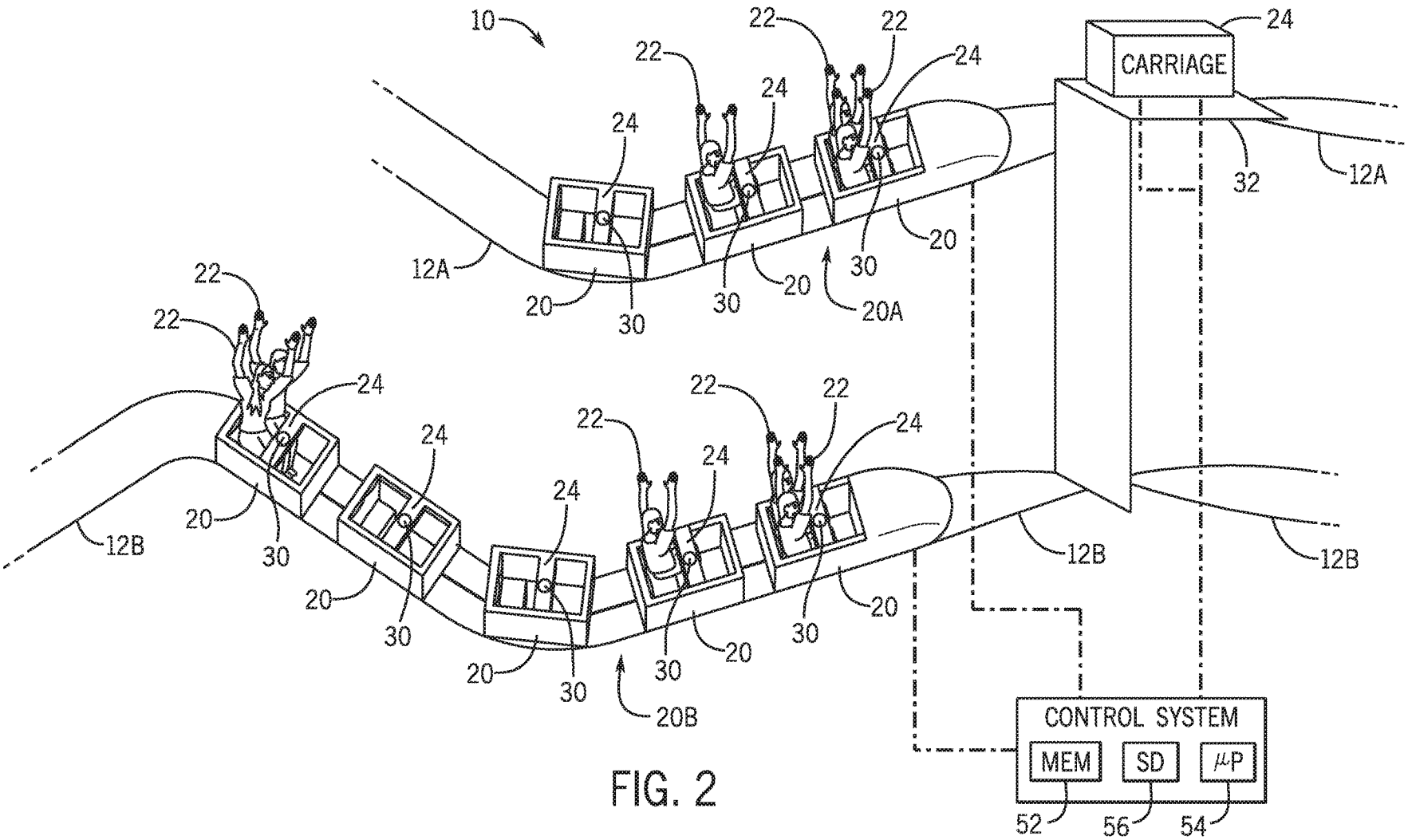
FIG. 2 is a schematic diagram of an embodiment a ride system, in accordance with aspects of the present disclosure.

FIG. 2 is a schematic diagram of an embodiment of the ride system 10, in accordance with aspects of the present disclosure. The ride system 10 may include multiple ride vehicles 20 coupled together via a linkage to join passengers 22 riding in corresponding ride vehicles 20 in a common ride experience. In an embodiment, the ride vehicles 20 may be decoupled to one another, and may instead move independently of one another, for example, along respective and/or separate ride paths 12. In another embodiment, the ride vehicles 20 may move as sets.

For example, a first set 20A of ride vehicles 20 (e.g., three ride vehicles) may move along a first ride path 12A and a second set 20B of ride vehicles 20 (e.g., five ride vehicles) may move along a second ride path 12B. The first ride path 12A may be on a level positioned higher than the second ride path 12B. For example, the first ride path 12A may define a direction of travel for the ride vehicle 20 operating in a level above the second ride path 12B. The carriage 24 may receive the ride vehicles 20, individually or as sets (e.g., the first set or second set 20A, 20B) to transport the ride vehicle(s) 20 from along the first ride path 12A to the second ride path 12B or from any ride path 12 to any other ride path 12.

The control system 50 may instruct the carriage 24 to vertically displace to transport the ride vehicle 20 from the first ride path 12A on the first level to the second ride path 12B on the second (e.g., lower) level. Alternatively, the control system 50 may instruct the carriage 24 to vertically displace to transport the ride vehicle 20 from the first ride path 12A on the first level to the second ride path 12B on the second (e.g., lower) level and back to the first level, such that the ride vehicle 20 may continue to move along the first ride path 12A. By employing the embodiments disclosed herein, the control system 50 may displace a carriage 24 in a ride-enhancing manner to, in an embodiment, change a direction of travel (e.g., from along the first ride path 12A to the second ride path 12B). The carriage 24 may displace the passengers 22, while enhancing their ride experience, by subjecting the passenger to the experience-enhancing motion described in detail below. It should be understood that the control system 50 may instruct the ride vehicles 20 to travel along the ride path 12 in any desired manner.

Figure 3:
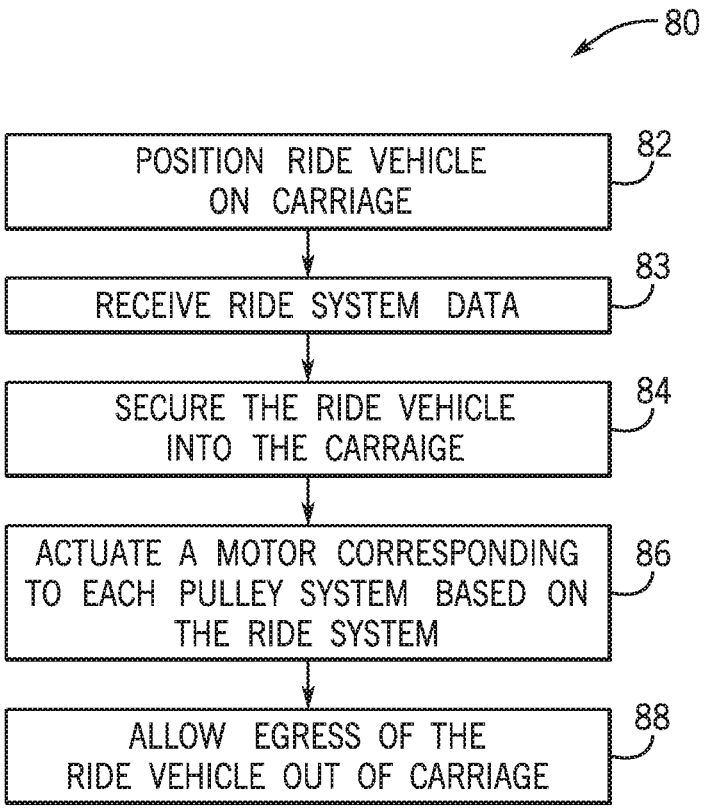
FIG. 3 is a flow diagram of a process for controlling motion of a carriage housing a ride vehicle operating in the ride system of FIG. 2, in accordance with aspects of the present disclosure.

FIG. 3 is flow diagram of a process 80 for controlling motion of a carriage 24 (FIGS. 1, 2) housing a ride vehicle 20 (FIGS. 1, 2) operating in the ride system 10 of FIG. 2, in accordance with aspects of the present disclosure. The process 80 may be implemented by the ride system 10. In a non-limiting embodiment, processor-based circuitry of the control system 50 (FIGS. 1, 2) may facilitate implementing the process 80. With the forgoing in mind, the control system 50 may position (process block 82) the ride vehicle 20 on the carriage 24 (FIGS. 1, 2) at a target position on the carriage 24. The control system 50 may actuate the stopping device 26 (FIG. 1) to cause the ride vehicle 20 to stop on the carriage 24 at the position in which the ride vehicle 20 may engage with the securing device 28 (FIG. 1). For example, the target position may be a position on the carriage 24 at which the securing device 28 may engage with compatible features of the ride vehicle 20 (e.g., female or male connectors).

The control system 50 may receive (process block 83) ride system data from sensor assemblies 51 associated with the ride system 10 (FIGS. 1, 2) prior to, during, or after controlling motion of the carriage 24. In this manner, the control system 50 may receive ride system data, such as a position, velocity, and acceleration of the ride vehicle 20, an engaging state (e.g., engaged or disengaged) of the stopping device 26 and securing device 28, a position, velocity, or acceleration of the pulley cable 38 and/or motor 36, an engaging state of the carriage 24 relative to the platform assembly 32, a position of the platform assembly 32, and the like, to facilitate control of the features in the ride system 10. The control instructions sent from the control system 50 to the various features of the amusement park 8 may be based on the ride system data, a subset of the ride system data, and/or any additional data.

The control system 50 may secure (process block 84) the ride vehicle 20 to the carriage 24 based on the ride system data. After verifying that the ride vehicle 20 is properly positioned on the carriage 24, the control system 50 may engage the securing device 28 to secure (process block 84) the ride vehicle 20 into the carriage 24. For example, after verifying that the ride vehicle 20 is stopped and positioned on the carriage 24 at the target position, the control system 50 may engage the securing device 28 to secure the ride vehicle to the carriage 24, such that the ride vehicle 20 becomes fixed to the carriage (e.g., at one or more connection points). The securing device 28 may include a plurality of mechanisms to redundantly secure the ride vehicle 20 to the carriage 24. For example, the securing device 28 may secure (process block 84) the ride vehicle 20 to the floor of the carriage 24, to the sides of the carriage 24, to the ceiling of the carriage 24, or any combination thereof, among any additional suitable location on the carriage 24. In this manner, motion of the ride vehicle 20 and the carriage 24 may be coordinated, such that the ride vehicle 20 and carriage 24 may operate as a single feature (e.g., a multi-DOF elevator).

To control motion of the carriage 24, the control system 50 may actuate (process block 86) the motor 36 corresponding to each pulley system 34, as described in detail below. Each motor 36 may be communicatively coupled to the control system 50, such that the control system 50 may control each motor 36 to drive motion of the corresponding pulley cables 38. In an embodiment, the control system 50 may supply electrical power (e.g., AC or DC current) to drive motion of the corresponding pulley cable 38 to, in turn, drive motion of the carriage 24. In an embodiment, the carriage 24 may be coupled to the pulley cables 38, such that when the control system 50 drives motion of the pulley cables 38, the corresponding portion of the carriage 24 coupled to the pulley cables 38 to displace in a substantially similar manner. For example, for a carriage 24 coupled to four pulley cables 38 at each of four portions of the carriage, the control system 50 may control motion for each of the four portions of the carriage 24 by actuating the motor 36 to drive the pulley cables 38 in motion based on the ride system data.

In an embodiment, the carriage 24 may be removably coupled to a platform assembly 32 (FIG. 1), such that the platform assembly 32 may include a securing mechanism that secures the carriage 24 to the platform assembly 32. In response to the motors 36 actuating, the control system 50 may disengage the securing device on the platform assembly 32 to allow the carriage 24 to move relative to the platform assembly 32, as described in detail below.

After actuating the motor 36 and causing the carriage 24 to execute a thrill-enhancing motion, the control system 50 may stop motion of the carriage 24 and position the carriage 24 on the platform assembly 32 and/or secure the carriage 24 to the platform assembly 32 to allow (process block 88) the ride vehicle 20 to exit the carriage 24. Prior to allowing exit the ride vehicle 20, the control system 50 may verify that the carriage 24 and the ride path 12 mate in such a manner that the ride vehicle 20 may seamlessly transition from the carriage 24 to the ride path 12. Additionally or alternatively, the control system 50 may verify that the carriage 24 is secured to the platform assembly 32 before allowing (process block 88) the ride vehicle 20 to egress from the carriage 24. In an embodiment, the ride path 12 from which the ride vehicle 20 may egress onto may not be the same as the ride path 12 from which the ride vehicle 20 may have ingressed from. As such, in an embodiment, the carriage 24 may transport the ride vehicle to another ride path.

Figure 4:
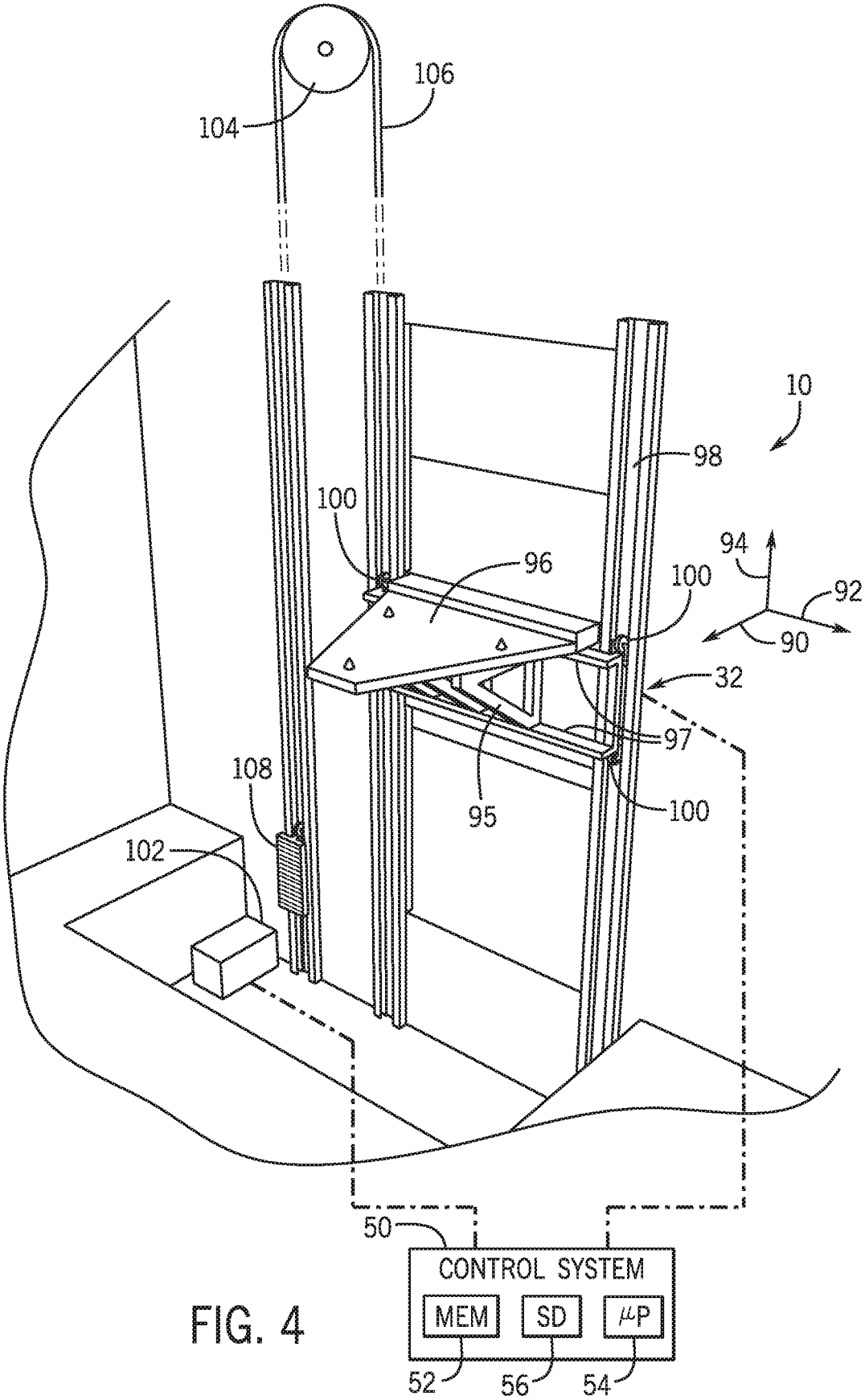
FIG. 4 is a schematic diagram of an embodiment of a platform assembly configured to support the carriage of FIG. 3, in accordance with aspects of the present disclosure.

FIG. 4 is a schematic diagram of an embodiment of the platform assembly 32 configured to support the carriage 24 of FIG. 3, in accordance with aspects of the present disclosure. To facilitate discussion, a coordinate system including a longitudinal axis 90, a lateral axis 92, and a vertical axis 94 (e.g., oriented parallel to a gravity vector) is illustrated. The platform assembly 32 may include one or more bracket members 95 to support a platform base 96. The bracket members 95 may be fixed to bar members 97 extending along the width of the platform base 96.

In the illustrated embodiment, the platform base 96 may extend along the longitudinal axis 90 outward from vertical rails 98. While the carriage 24 is supported by the platform assembly 32, the carriage 24 may be positioned on the platform base 96. The platform base 96, bracket members 95, and bar members 97 may be manufactured out of any material (e.g., steel alloy, copper, aluminum) configured to support at least the weight of the carriage 24, the passengers 22 (FIGS. 1, 2), and the one or more ride vehicles 20 housed within the carriage 24. Furthermore, while the depicted platform base 96 is quadrilateral in shape, the platform base 96 may be of any suitable shape (e.g., circular, triangular, rectangular, octagonal, or round) that may support the carriage and the one or more ride vehicles 20.

The platform assembly 32 may include vertical rails 98 that allow the platform base 96 to transport the platform base 96 along the vertical axis 94. For example, the platform assembly 32 may include a plurality of rollers 100 that engage with the vertical rails 98 and rotate about the lateral axis 92 to drive vertical motion of the platform base 96. Motion of the platform base 96 may be realized via a motor 102 communicatively coupled to the control system 50, such that the motor 102 may receive control instructions to drive vertical motion of the platform base 96. In an embodiment, the motor 102 may receive control instructions from the control system 50 to control the current or voltage supplied to the vertical rails 98 to drive rotation of the rollers 100 and motion of the platform base 96. In another embodiment, the motor 102 may receive control instructions from the control system 50 to control a winch 104 that may drive motion a pulley cable 106 coupled to the platform base 96. The platform assembly 32 may include a counterweight 108 that may reduce the force needed to control the vertical motion of the platform base 96. While motion of the platform base 96 is discussed as being driven via a motor system using a motor 102, the platform assembly 32 may include a pneumatic system, a motor system, a tire drive system, fins coupled to an electromagnetic drive system, a catapult system, and the like, to actively or passively drive the platform base 96. Further, the motor 102 may be integral or incorporated into the winch 104.

Figure 5:
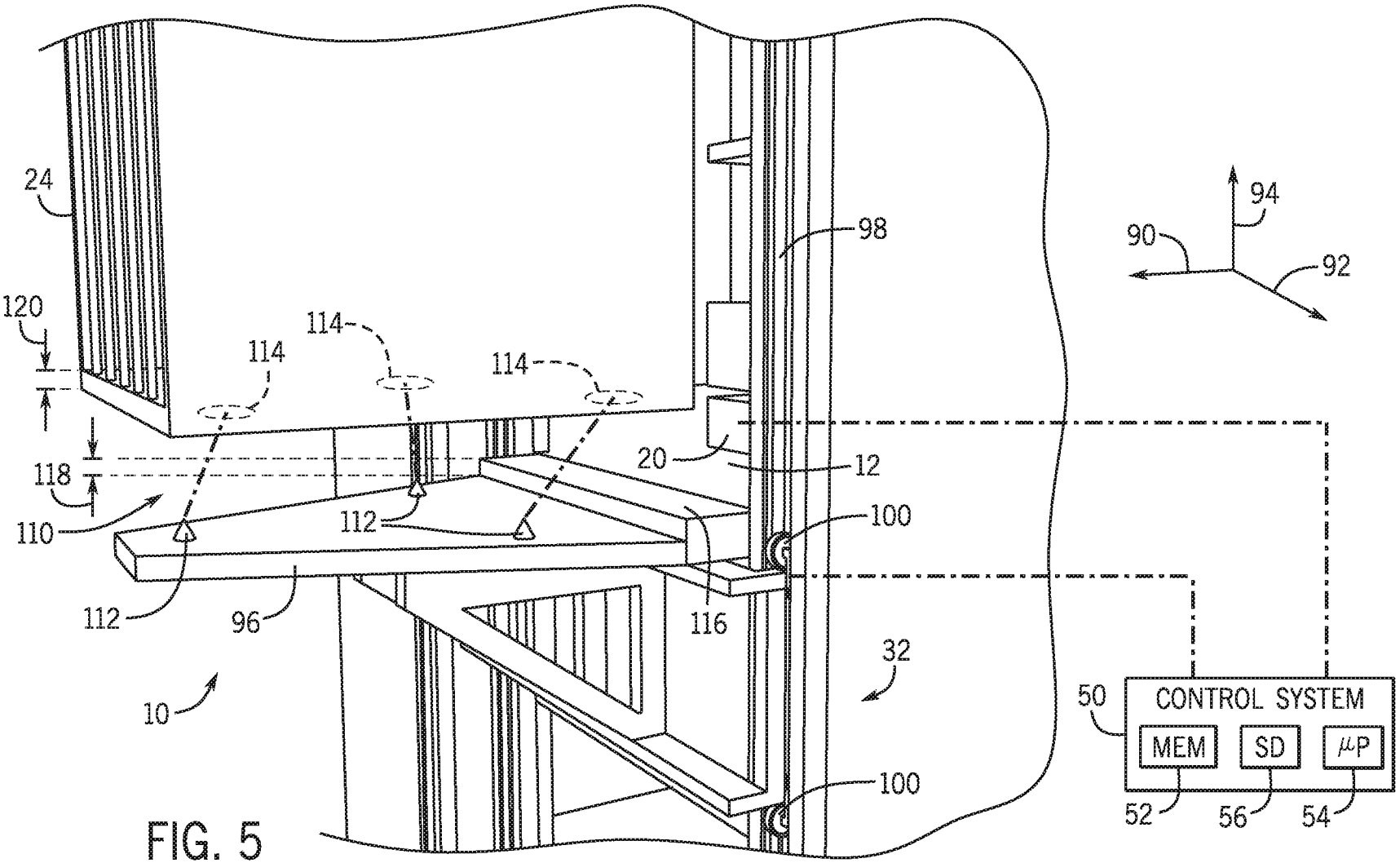
FIG. 5 is a schematic diagram of an embodiment of the platform assembly of FIG. 4 and an alignment mechanism configured to align the carriage of FIG. 3 while supported by the platform assembly of FIG. 4, in accordance with aspects of the present disclosure.

FIG. 5 is a schematic diagram of an embodiment of the platform assembly 32 of FIG. 4 and an alignment mechanism 110 configured to align the carriage 24 of FIG. 3 while supported by the platform assembly 32 of FIG. 4, in accordance with aspects of the present disclosure. The alignment mechanism 110 may include alignment pins 112 on the platform base 96 and openings 114 on the lower surface of the carriage 24, such that the each of the alignment pins 112 may engage with a corresponding opening 114. The alignment pins 112 may have a conical contour that extends vertically upward from the platform base 96 along the vertical axis 94, and the corresponding openings 114 may have a similar contour to engage with the alignment pins 112. The conical contour of the alignment pins 112 and the openings 114 may mate with one another to facilitate placement of the carriage 24 on the platform assembly 32. The alignment mechanism 110 may facilitate maintaining contact between the platform base 96 and the carriage 24, and prevent the carriage 24 from sliding or rotating off the platform assembly 32 (e.g., by rotating about the vertical axis 94, the longitudinal axis 90, and the lateral axis 92).

Furthermore, the platform assembly 32 may include a back stabilizer 116, which includes a raised surface having a height 118 raised vertically upward from the top of the platform base 96. The height 118 may be substantially similar in size to a thickness 120 of the base of the carriage 24. In this manner, the back stabilizer 116 may facilitate transition of the ride vehicle 20 from the ride path 12 to the carriage 24. For example, in transitioning from the ride path 12 (FIG. 1, 2) to the carriage 24, the ride vehicle 20 (FIG. 1, 2) may travel from the ride path 12 to the back stabilizer 116 and onto the carriage 24. It should be appreciated, that in another embodiment, the back stabilizer 116 may be omitted, such that the top thickness 120 is level with the ride path 12 to facilitate seamless transition of the ride vehicle 20.

Although not illustrated, the securing mechanism that secures the carriage 24 to the platform assembly 32 (e.g., to the platform base 96) may be positioned on the platform base 96 and be enhanced by the alignment mechanism 110. In an embodiment, the securing mechanism of the platform assembly 32 may be integral to the alignment mechanism 110.

Figure 6:
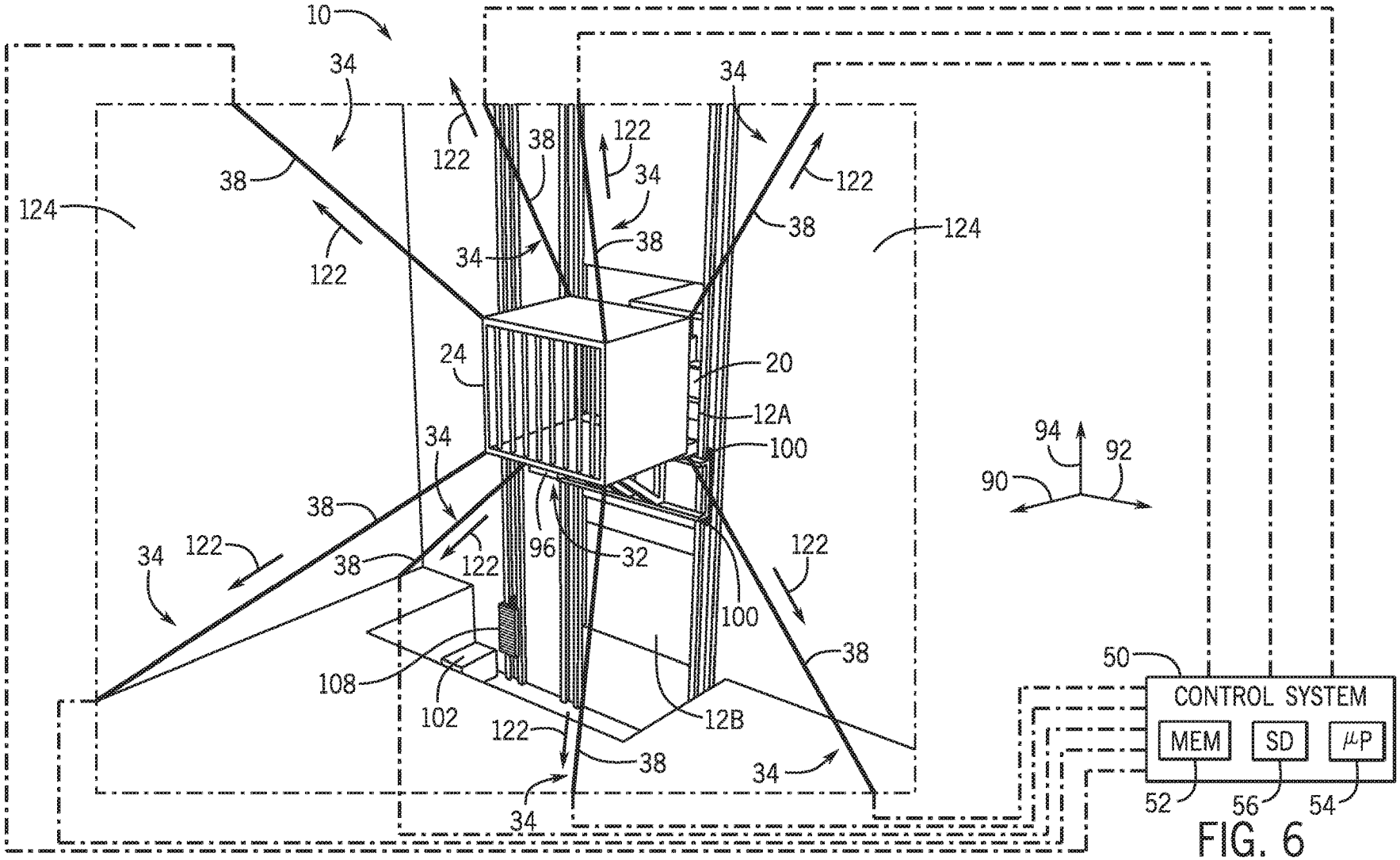
FIG. 6 is a schematic diagram of an embodiment of the carriage of FIG. 3 supported by the platform assembly of FIG. 4, in accordance with aspects of the present disclosure.

FIG. 6 is a schematic diagram of an embodiment of the carriage 24 of FIG. 3 supported by the platform assembly 32 of FIG. 4, in accordance with aspects of the present disclosure. The ride system 10 may include a two-level ride that may include the first ride path 12A which may be positioned on a level higher than the second ride path 12B. The ride system 10 may include eight pulley systems 34 each communicatively coupled to the control system 50, such that the control system 50 may control the pulley cables 38 to control motion of the carriage 24. As illustrated, eight pulley cables 38 may couple to respective edges of the carriage 24, but it should be understood that any number of pulley cables 38 may couple to any position on the carriage 24. The pulley cables 38 may be pretensed, such that all eight cables are similar in length.

As illustrated, the carriage 24 may remain rigidly fixed to the platform assembly 32 while the carriage 24 receives or awaits to receive and secure one or more of the ride vehicles 20. For example, the securing mechanism of the platform assembly 32 may rigidly fix the carriage 24 to the platform to restrict motion of the carriage 24 relative the platform assembly 32. Furthermore, while the carriage 24 receives or awaits to receive and secure the ride vehicle 20, the platform assembly 32 may remain fixed in place (e.g., in response to certain control instructions, a response from the motor 102, and/or assistance from the counterweight 108) such that vertical motion of the platform assembly 32 is restricted. Alternatively or additionally, the control system 50 may actuate a motor 36 (FIG. 1) corresponding to each pulley system 34 to pull each pulley cable 38 along a corresponding outward direction 122. In this manner, the load the carriage 24 exerts on the platform assembly 32 may be reduced as the tension in the pulley cables 38 may suspend or partially suspend the carriage 24.

Figure 7:
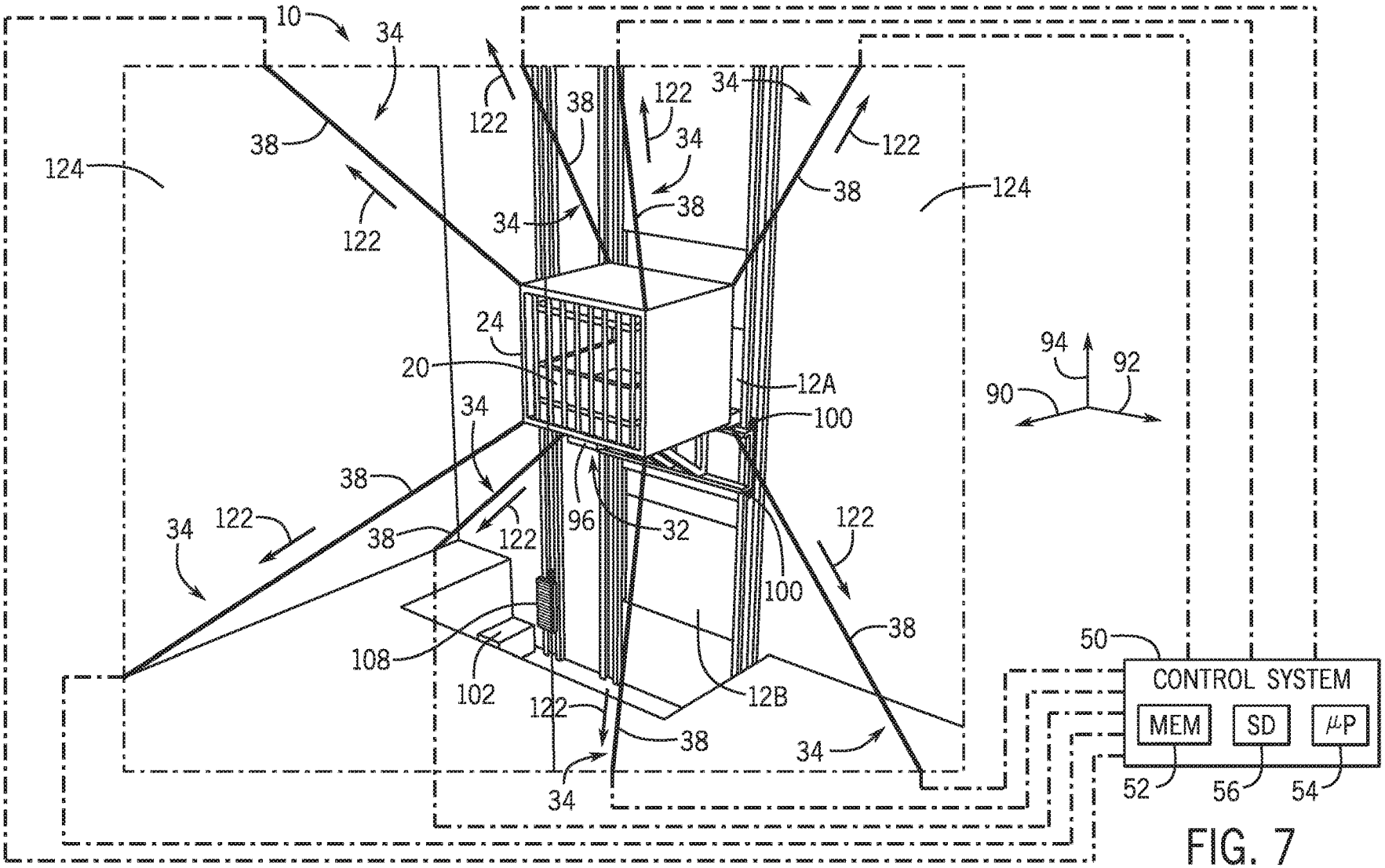
FIG. 7 is a schematic diagram an embodiment of the carriage of FIG. 3 receiving and securing the ride vehicle of FIG. 3, in accordance with aspects of the present disclosure.

FIG. 7 is a schematic diagram an embodiment of the carriage 24 of FIG. 3 receiving and securing the ride vehicle 20 of FIG. 3, in accordance with aspects of the present disclosure. The ride paths 12 (e.g., the first ride path 12A and the second ride path 12B) may remain partially hidden from the passengers 22 (FIGS. 1, 2) by walls 124. For example, in an embodiment, the motors 36 corresponding to the pulley cables 38 may be hidden behind walls, such that the mechanisms causing motion of the pulley cables 38 remains hidden from the passengers 22. Additionally, after the ride vehicle 20 exits the ride path 12, a door may raise from the level or swing shut to further hide the ride path 12 from the passengers 22.

The control system 50 may direct motion of the ride vehicle 20 along the longitudinal direction 90 via the first ride path 12A and engage the stopping device 26 (FIG. 1) and the securing device 28 (FIG. 1) in response to determining (e.g., via sensor assemblies 51) that the ride vehicle 20 is stopped on a target position on the carriage 24 and secured to the carriage 24. After verifying that the ride vehicle 20 is secured to the carriage 24, the control system 50 may send control instructions to the platform assembly 32 to disengage the securing mechanism to allow the carriage 24 to be moved via actuation of the pulley systems 34. For example, the control system 50 may send control instructions to each of the pulley systems 34 to control motion of the carriage 24 (and the secured ride vehicle 20), as described in detail below.

Figure 8:
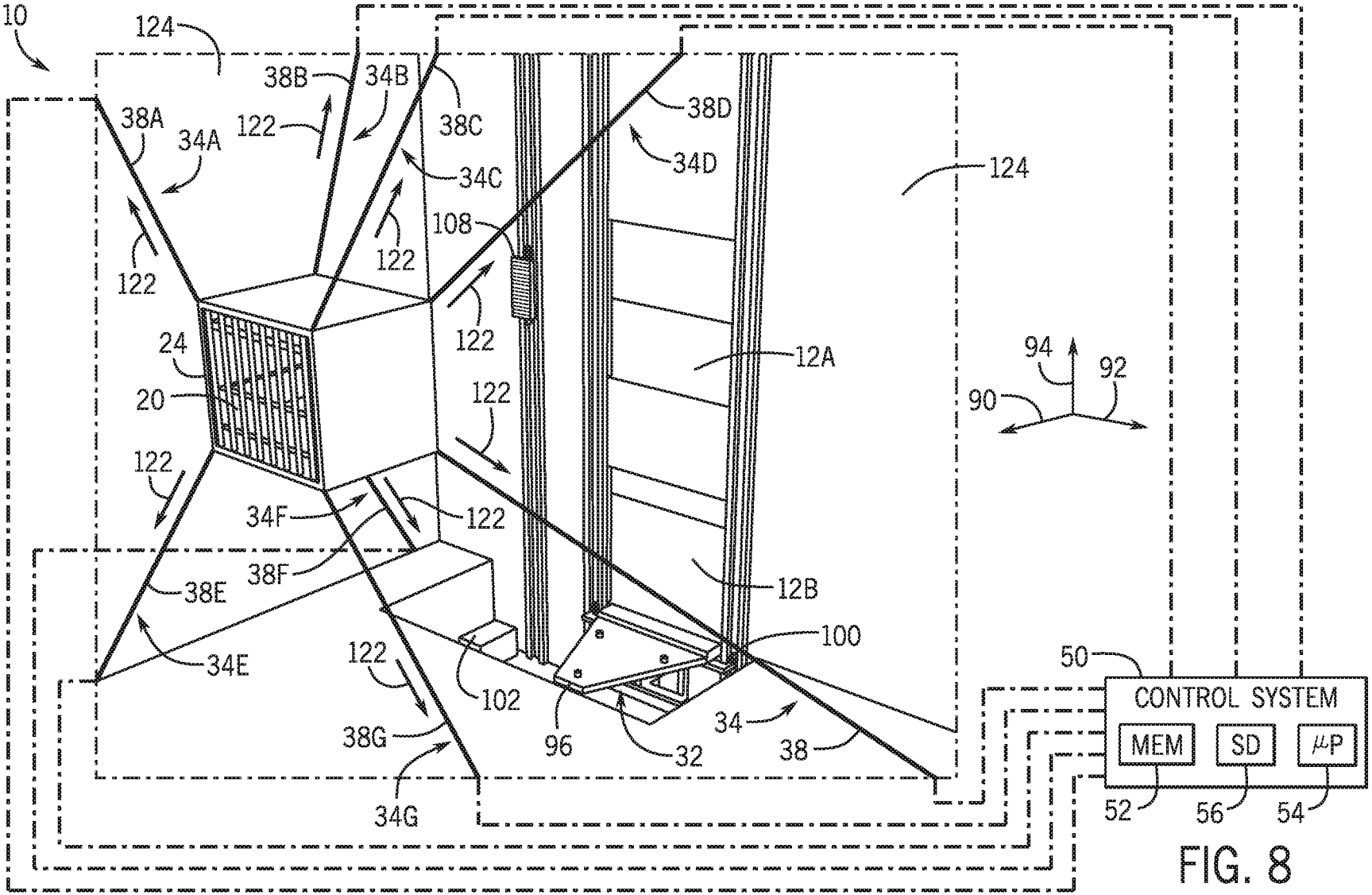
FIG. 8 is a schematic diagram an embodiment of a pulley system being actuated to control motion of the carriage of FIG. 3, in accordance with aspects of the present disclosure.

To help illustrate, FIG. 8 is a schematic diagram an embodiment of the pulley system 34 being actuated to control motion of the carriage of FIG. 3, in accordance with aspects of the present disclosure. The control system 50 may send control instructions to the upper pulley systems (e.g., pulley systems 34A, 34B, 34C, 34D), such that the corresponding motors 36 of FIG. 1 (not illustrated) cause the upper pulley cables to exert more force than the lower pulley cables (e.g., pulley cables 38E, 38F, 38G, 38H) to lift the carriage 24 from the platform assembly 32. For example, the motors 36 corresponding to the upper pulley cables may cause the upper pulley cables to retract along the outward direction 122 to lift the carriage 24 off the platform assembly 32. While lifting the carriage 24, the lower pulley cables may freely extend (move opposite the outward direction 122), for example, by freely rotating about a corresponding winch, to facilitate upward motion of the carriage 24.

In an embodiment, the control system 50 may control motion of the carriage 24 by controlling the input (e.g., current input) to the motors 36 that drive motion of the pulley cables 38. In this manner, the control system 50 may control motion of the carriage 24 by retracting or extending the pulley cables 38 to target positions and/or at target velocities. To enable this control of the pulley cables 38, the control system 50 may receive ride system data from sensor assemblies 51 (FIG. 1) to control the pulley cables 38 individually or as sets. For example, as illustrated, the leftmost pulley cables (e.g., pulley cables 38A, 38B, 38E, 38F) may be retracted along the outward direction 122 in response to their corresponding motor 36 causing the leftmost pulley cables to exert a pulling force on the carriage 24. As may be appreciated, the pulley cables 38 may be controlled to control motion of the carriage 24 along or about the longitudinal axis 90, the lateral axis 92, and/or the vertical axis 94.

After the carriage 24 decouples from the platform assembly 32, the platform base 96 may be lowered to be level with the second ride path 12B. As described above, the platform base 96 may be lowered, for example, by actuating the motor 102 until the back stabilizer 116 is level with the second ride path 12B to facilitate ride vehicle egression from the carriage 24. In another embodiment, absent the back stabilizer 116, the platform base 96 may be lowered until the base of the carriage 24 is level with the second ride path 12B to facilitate ride vehicle egression from the carriage 24 onto the second ride path 12B.

Figure 9:
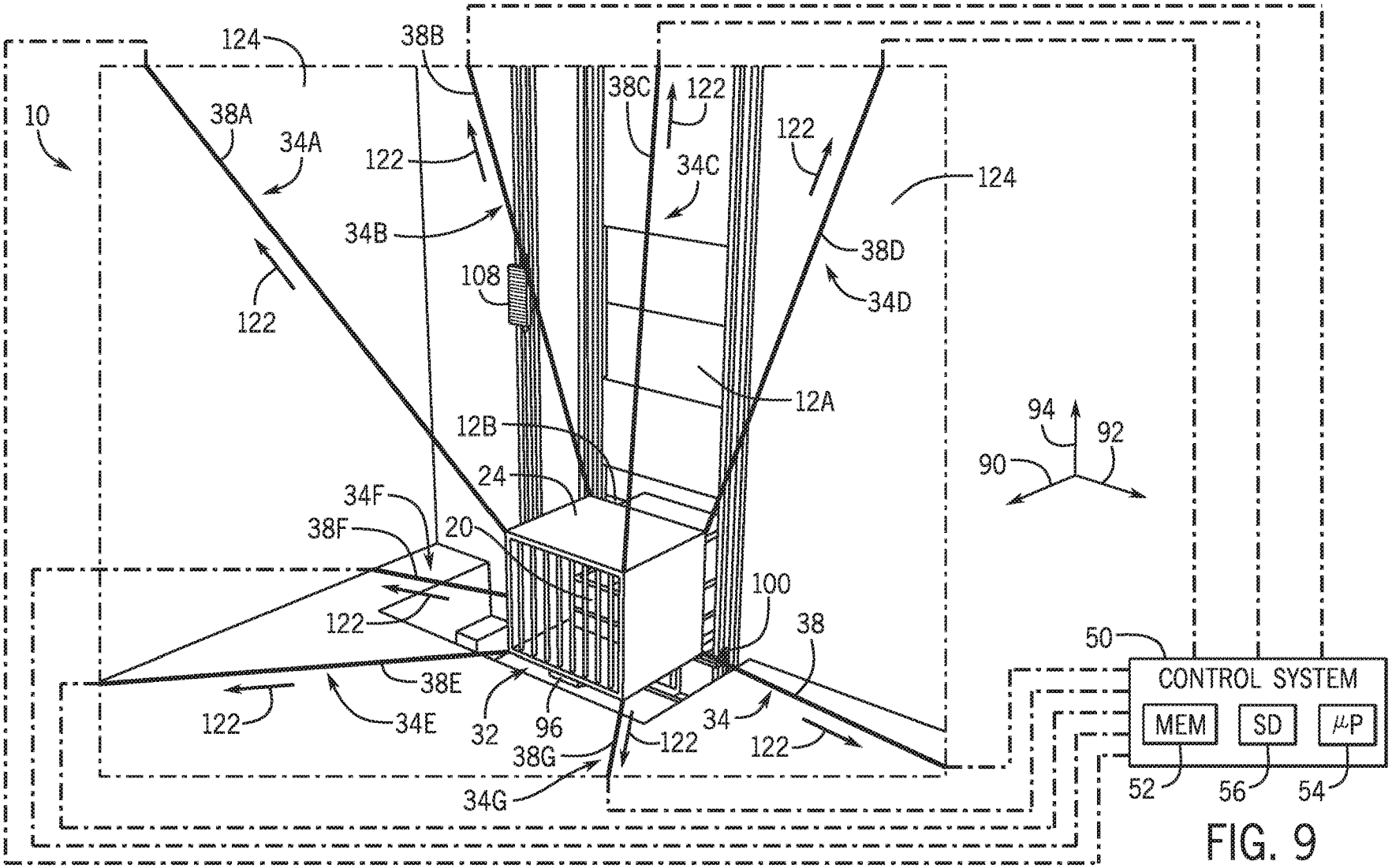
FIG. 9 is a schematic diagram of an embodiment of the pulley system of FIG. 8 being actuated to drive the motion of the carriage of FIG. 3 to the platform assembly of FIG. 4, in accordance with aspects of the present disclosure.

FIG. 9 is a schematic diagram of an embodiment of the pulley system 34 of FIG. 8 being actuated to drive the motion of the carriage 24 of FIG. 3 to the platform assembly 32 of FIG. 4, in accordance with aspects of the present disclosure. The control system 50 may control the pulley systems 34, such that the control system 50 controls motion of the pulley cables 38 such that the carriage 24 is positioned over the platform assembly 32 and lowered to the platform assembly 32. After positioning the carriage 24 over the platform assembly 32, the securing mechanism of the platform assembly 32 may engage to secure the carriage 24 to the platform assembly 32. After verifying that the carriage 24 is secured to the platform assembly 32, the control system 50 may instruct the ride vehicle 20 to exit the carriage 24 onto the second ride path 12B.

Figure 10:
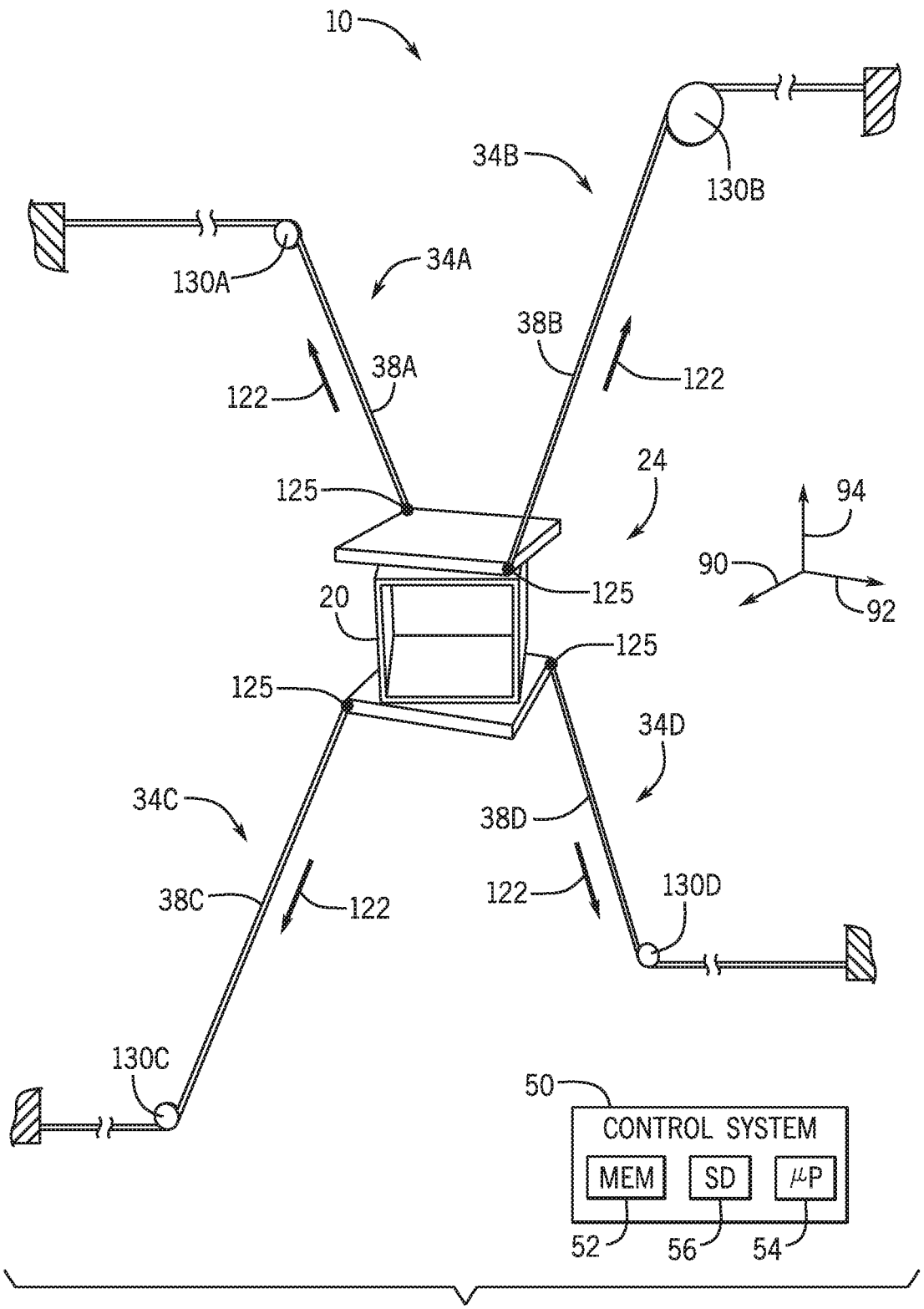
FIG. 10 is a schematic diagram of an embodiment of the carriage of FIG. 3 having four pulley systems in an open-loop configuration, in accordance with aspects of the present disclosure.

FIG. 10 is a schematic diagram of an embodiment of the carriage 24 of FIG. 3 having four pulley systems 34 in an open-loop configuration, in accordance with aspects of the present disclosure. To facilitate discussion, the ride system 10 is illustrated in the embodiments of FIGS. 10-16 with certain of the aforementioned features omitted. However, it should be understood that the embodiment of FIGS. 10-16 may include the platform assembly 32, the walls 124, and one or more ride paths 12, such that the carriage 24 may receive the ride vehicle 20 from the first ride path 12A and/or transport the ride vehicle to the second ride path 12B (or vice-versa) after executing thrill-enhancing motion, and allow the ride vehicle 20 to continue motion along the first or second ride path, based on instructions from the control system 50. As mentioned above, the instructions from the control system 50 may be based on ride system data from the sensor assemblies 51 (FIG. 1), for example, used to determine ride system data.

Figure 11:
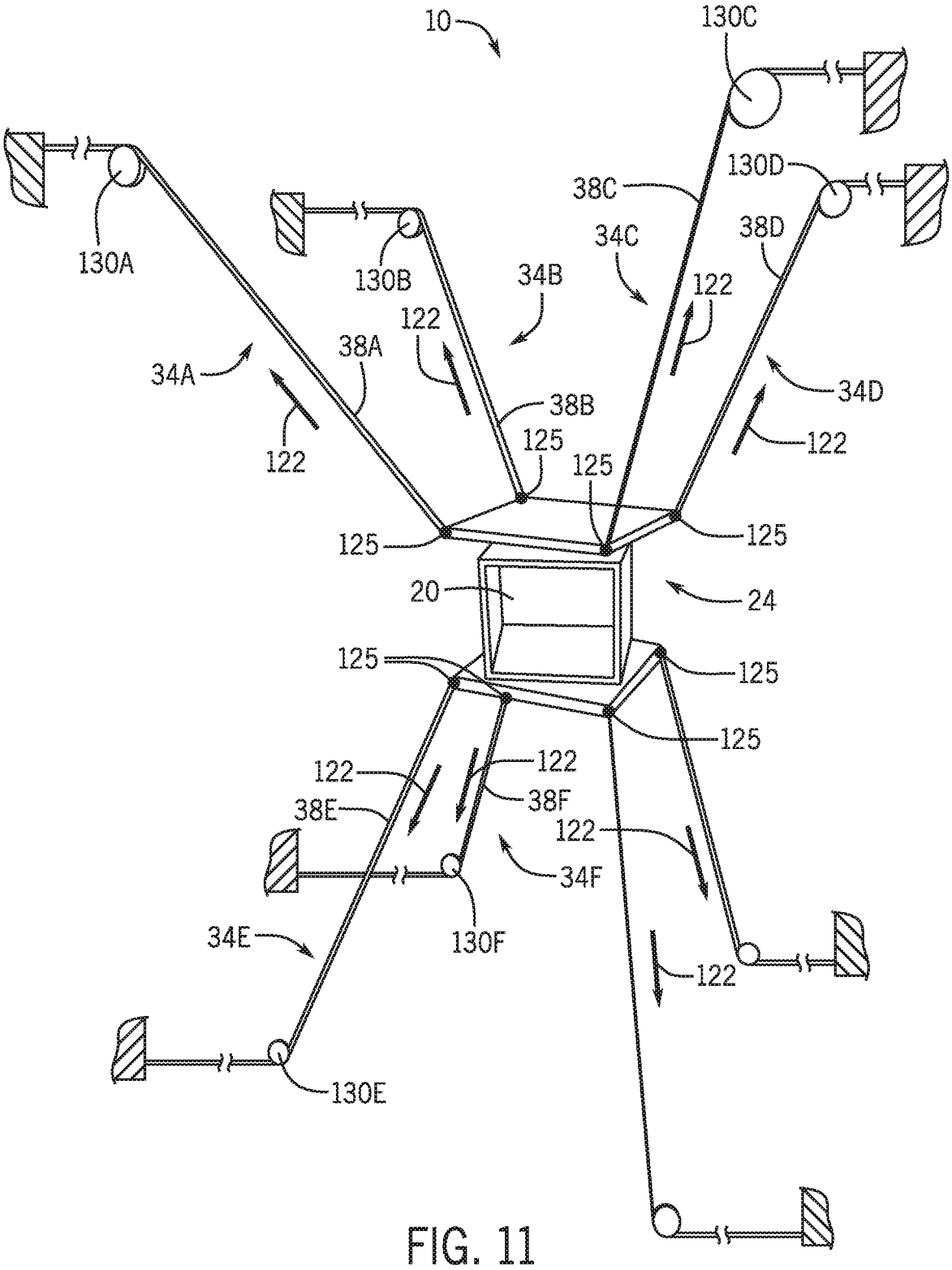
FIG. 11 is a schematic diagram of an embodiment of the carriage of FIG. 3 having eight pulley systems in an open-loop configuration, in accordance with aspects of the present disclosure.

Furthermore, in the embodiments of FIGS. 10 and 11, the control system 50 may actuate devices in the ride system 10 to cause the ride vehicle 20 to perform five DOF motion; for example, heave motion (e.g., motion along the vertical axis 94), pitch motion (e.g., motion about the lateral axis 92), roll motion (e.g., motion about the longitudinal axis 90), surge motion (e.g., motion along the longitudinal axis 90), and sway motion (e.g., motion along the lateral axis 92). In the embodiments of FIGS. 12-16, the control system 50 may actuate devices in the ride system 10 to cause the ride vehicle 20 to perform three DOF motion; for example, heave motion (e.g., motion along the vertical axis 94), pitch motion (e.g., motion about the lateral axis 92), and roll motion (e.g., motion about the longitudinal axis 90). However, it should be understood that the passengers may experience six DOF motion in response to the control system 50 additionally actuating devices (e.g., turntable, a yaw drive system, or any experience-enhancing motion-based platform) of the ride vehicle 20.

The pulley systems 34 (e.g., pulley systems 34A, 34B, 34C, 34D) may receive control instructions from the control system 50 to drive a corresponding motor 30 (e.g., motors 30A, 30B, 30C, 30D) in rotation to retract or extend the corresponding pulley cables 38. As illustrated, the origins of the pulley cables 38 on the carriage 24 spread outward (e.g., in outward direction 122) from the contact points 125 on the carriage 24 to facilitate motion along the longitudinal axis 90, along the lateral axis 92, along the vertical axis 94, about the longitudinal axis 90, and/or about the lateral axis 92.

To further facilitate this motion, the upper pulley cables (e.g., the pulley cables 38A, 38B) and the lower pulley cables (e.g., the pulley cables 38C, 38D) may be positioned on respectively opposite corners from one another on the carriage 24. For example, in an embodiment, the two upper cables are positioned on opposite corners of the top of the carriage 24, and the two lower cables are positioned on opposite corners of the bottom of the carriage 24, such that the two upper cables are on corresponding corners different than the corners on which the two lower cables are coupled. While the pulley cables 38 having the open-loop configuration in the illustrated embodiment of FIG. 10 include four pulley systems 34, it should be understood that the carriage 24 may include any number of pulley cables 38 having the open-loop configuration. To help illustrate, FIG. 11 is a schematic diagram of an embodiment of the carriage 24 of FIG. 3 having eight pulley systems 34 in an open-loop configuration, in accordance with aspects of the present disclosure. Alternatively or additionally, the pulley systems 34 may be arranged in a closed-loop configuration.

Figure 12:
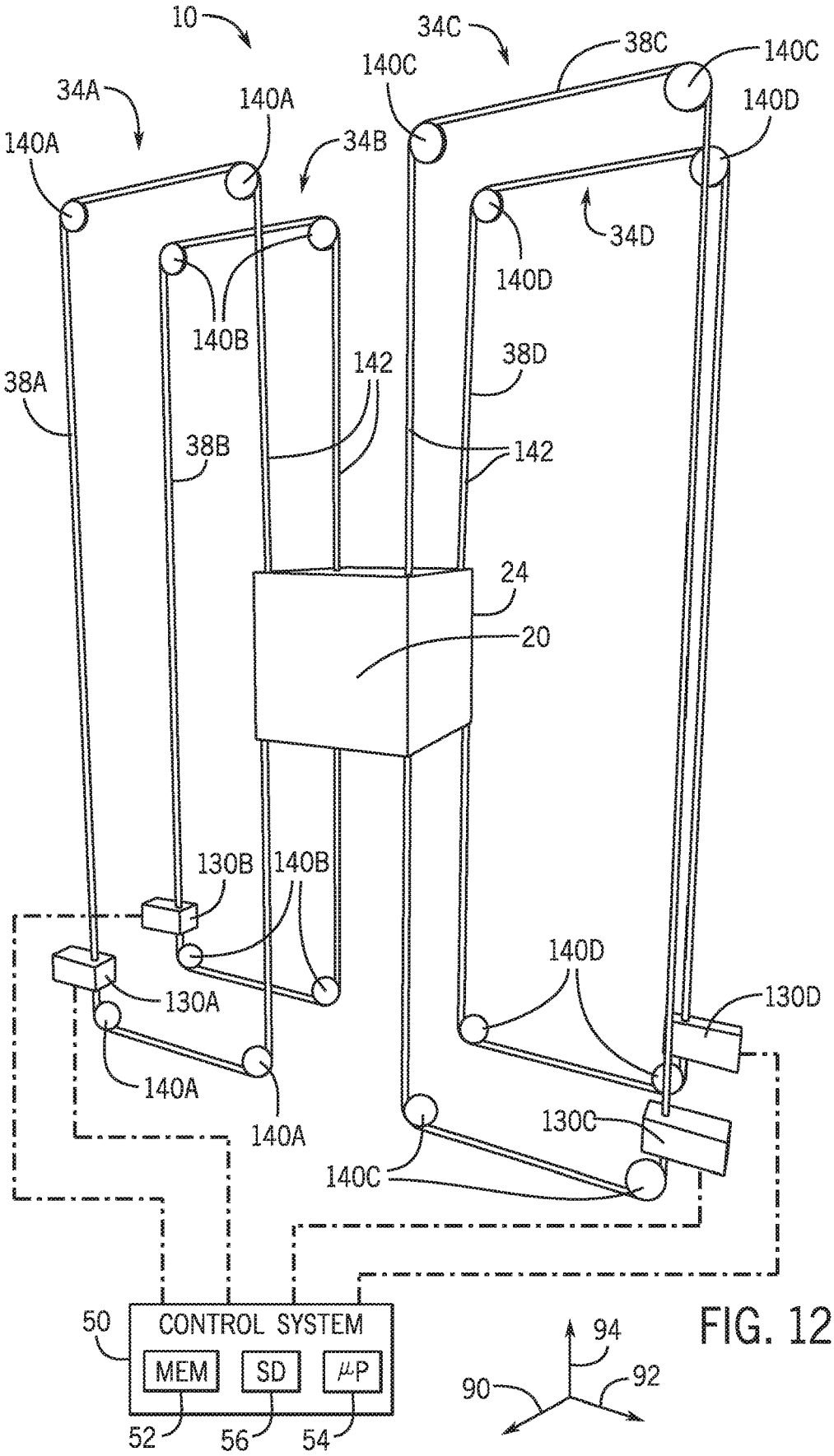
FIG. 12 is a schematic diagram of an embodiment of the carriage of FIG. 3 having four pulley systems in an closed-loop configuration, in accordance with aspects of the present disclosure.

To that end, FIG. 12 is a schematic diagram of an embodiment of the carriage 24 of FIG. 3 having four pulley systems 34 in a closed-loop configuration, in accordance with aspects of the present disclosure. As described above, the carriage 24 may contact the same points on the pulley cables 38 during the duration of the ride. In this manner, actuating one of the motors 30 to drive the corresponding pulley cable 38 in rotation causes the carriage 24 to be driven in motion, as motion of the carriage 24 may be based on motion of the pulley cables 38. To facilitate discussion, the ride system 10 includes a first pulley system 34A, having a first motor 30A, a first set of winches 140A, and first pulley cable 38A; a second pulley system 34B, having a second motor 30B, a second set of winches 140B, and second pulley cable 38B; a third pulley system 34C, having a third motor 30C, a third set of winches 140C, and third pulley cable 38C; and a fourth pulley system 34D, having a fourth motor 30D, a fourth set of winches 140D, and fourth pulley cable 38D.

The carriage 24 may be coupled to a plurality (e.g., four) of closed-loop pulley cables 38 that each pass through the carriage 24, such that the pulley cables 38 are hidden from the passengers 22 (FIG. 1, 2). The pulley systems 34 may each be associated with a plurality of (e.g. four) winches 140 that may freely rotate to enable translation of the pulley cables 38. In an embodiment, one of the winches 140 of each pulley system 34 may be a drive winch (e.g., includes the motor 30). As illustrated, the pulley cables 38 may be arranged in a quadrilateral configuration with a winch 140 on each edge of the quadrilateral configuration. The pulley cables 38 may include a portion 142 oriented substantially parallel to one another and substantially parallel to the vertical axis 94. Control instruction causing the motor 30 to actuate and drive the motion of the pulley cables 38 may also control the motion of the carriage 24, in accordance with the control instructions. Due to the substantially parallel arrangement of the portion 142 of the pulley cables 38 in contact with the carriage 24, vertical motion of the carriage 24 may be better controlled, for example, because the pulley cables 38 contact the carriage 24 at four contact points 125 (e.g., a contact point 125 at each corner of the top surface of the carriage 24) extending the height of the carriage 24 and the pulley cables 38 may be parallel to one another at respective portions 142.

In one embodiment, each of the four pulley cables 38 may extend between a top surface and a bottom surface of the carriage at different portions of the carriage, such that the four pulley systems 34 remain hidden to the passenger 22. In this configuration, the pulley cables 38 may be rigidly fixed to the inner surface of the carriage 24 via any suitable mechanisms, such as clamps, a ratcheting systems, and the like. In this manner, each pulley cable 38 may be driven in motion to drive the corresponding portion of the carriage 24, in a similar motion to control vertical motion, roll, and pitch of the carriage 24, as described in detail below.

As may be appreciated, the carriage 24 may receive the ride vehicle 20 (FIG. 1, 2) from the ride path 12 (FIG. 1, 2) oriented along the longitudinal axis 90 or the lateral axis 92. However, the carriage 24 may receive the ride vehicle 20 from any suitable direction. After receiving and securing the ride vehicle 20, the carriage 24 may be controlled to move vertically (e.g., along the vertical axis 94), about the longitudinal axis 90, or about the lateral axis 92.

Figure 13:
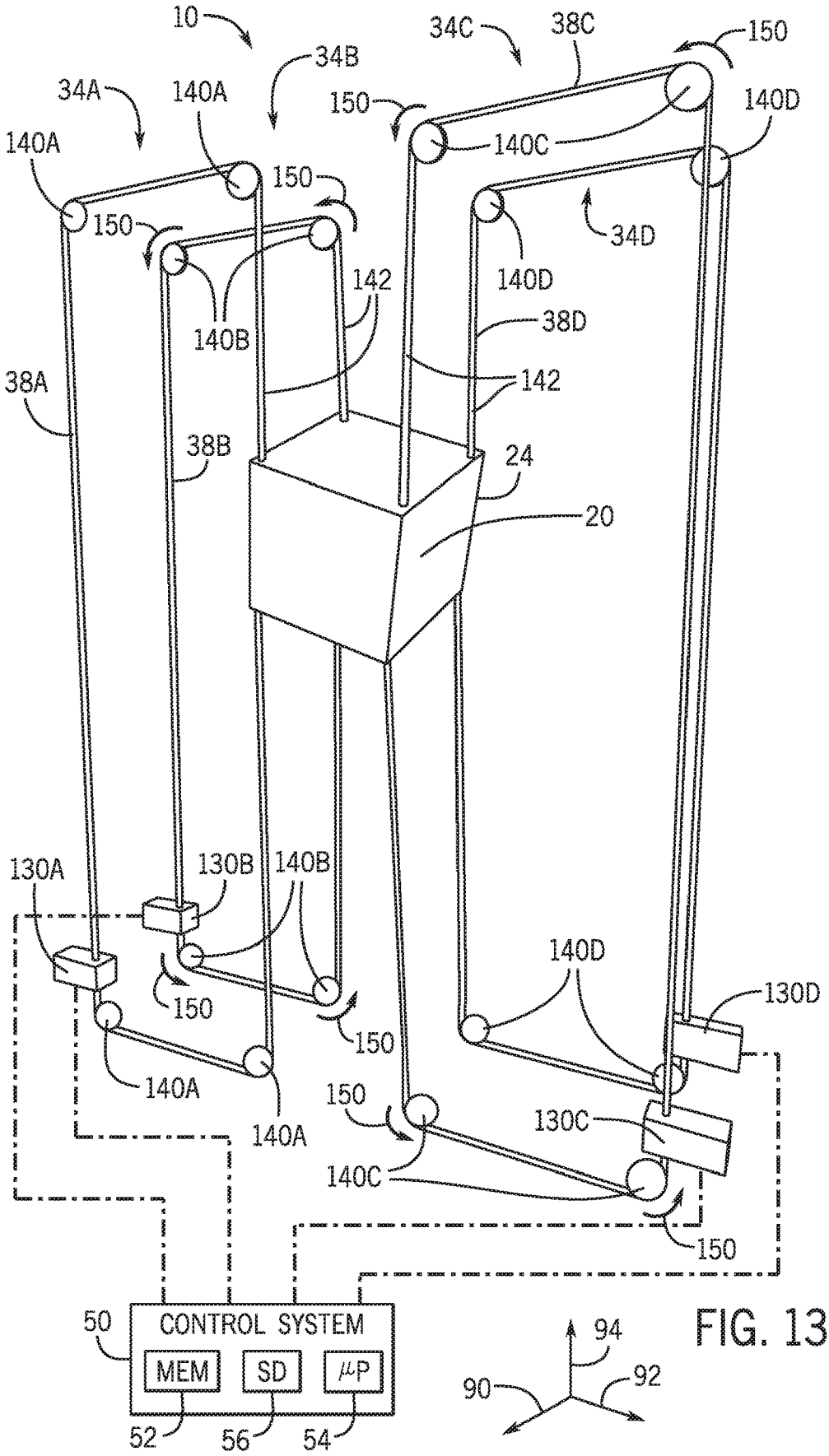
FIG. 13 is a schematic diagram of an embodiment of the four pulley systems of FIG. 12 driving motion of the carriage of FIG. 3, in accordance with aspects of the present disclosure.

To help illustrate, FIGS. 13-16 each include an embodiment of the control system 50 controlling motion of the carriage 24 by causing the motors 30 to drive their corresponding pulley cable 38 in motion. For example, FIG. 13 is a schematic diagram of an embodiment of the four pulley systems 34 of FIG. 12 driving motion of the carriage 24 of FIG. 3, in accordance with aspects of the present disclosure. In the embodiment illustrated in FIG. 13, the portion 142 of the second pulley cable 38B may be raised in response to the second motor 30B causing the second set of winches 140B to rotate in a first rotation direction 150 (e.g., counterclockwise), thereby raising the corner of the carriage 24 coupled to the second pulley cable 38B. Additionally, the portion 142 of the third pulley cable 38C may be lowered in response to the third motor 30C causing the third set of winches 140C to rotate in a first rotation direction 150, thereby lowering the corner of the carriage 24 coupled to the third pulley cable 38C.

Figure 14:
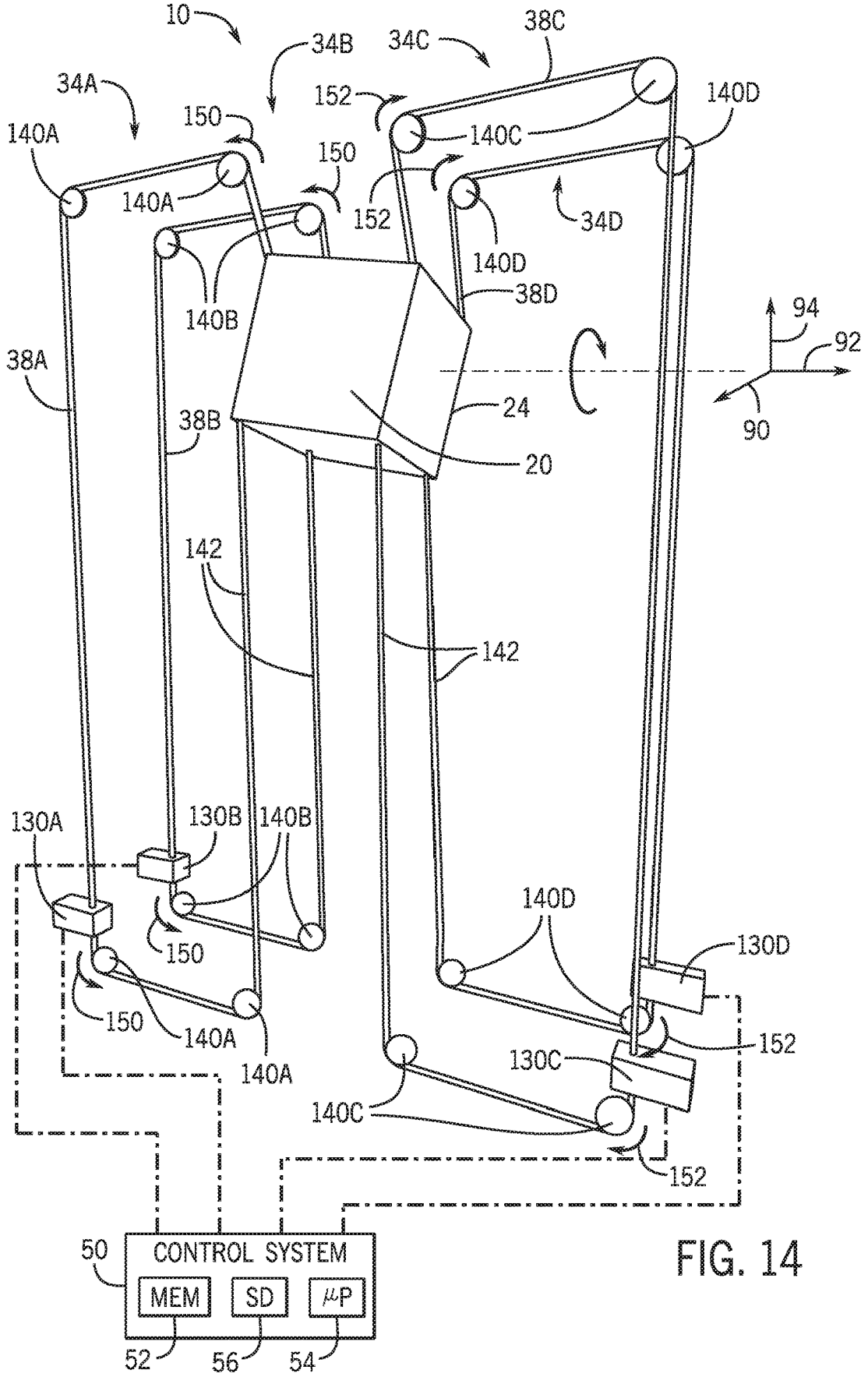
FIG. 14 is a schematic diagram of an embodiment of the four pulley systems of FIG. 12 raising the carriage of FIG. 3, in accordance with aspects of the present disclosure.

FIG. 14 is a schematic diagram of an embodiment of the four pulley systems 34 of FIG. 12 raising the carriage 24 of FIG. 3, in accordance with aspects of the present disclosure. In the embodiment illustrated in FIG. 14, the first and second motors 30A, 30B may cause the first and second sets of winches 140A, 140B to rotate in the first rotation direction 150, and the third and fourth motors 30C, 30D may cause the third and fourth winches 140C, 140D to rotate in the second rotation direction 152 (e.g., clockwise)), causing the carriage 24 to be moved along the vertical axis 94, based on control instructions. The control system 50 may cause rotation of the carriage 24 about the longitudinal and lateral axis 90, 92 in addition or alternative to causing vertical motion of the carriage by causing the winches to rotate at different rates or causing the pulley cables to be vertically displaced at different rates.

For example, the carriage 24 may rotate about the lateral axis 92, as illustrated, in response to the control system 50 instructing the first and third motors 30A, 30C to cause the first and third sets of winches 140A, 140C to rotate at a rate higher than the rate of rotation of the second and fourth sets of winches 140B, 140D. Similarly, the carriage 24 may rotate about the lateral axis 92, as illustrated, in response to the control system 50 instructing the first and third motors 30A, 30C to cause the portion 142 of the first and third pulley cables 38A, 38C to displace vertically at a rate higher than the rate of displacement of the portion 142 of the second and fourth pulley cables 38.

Figure 15:
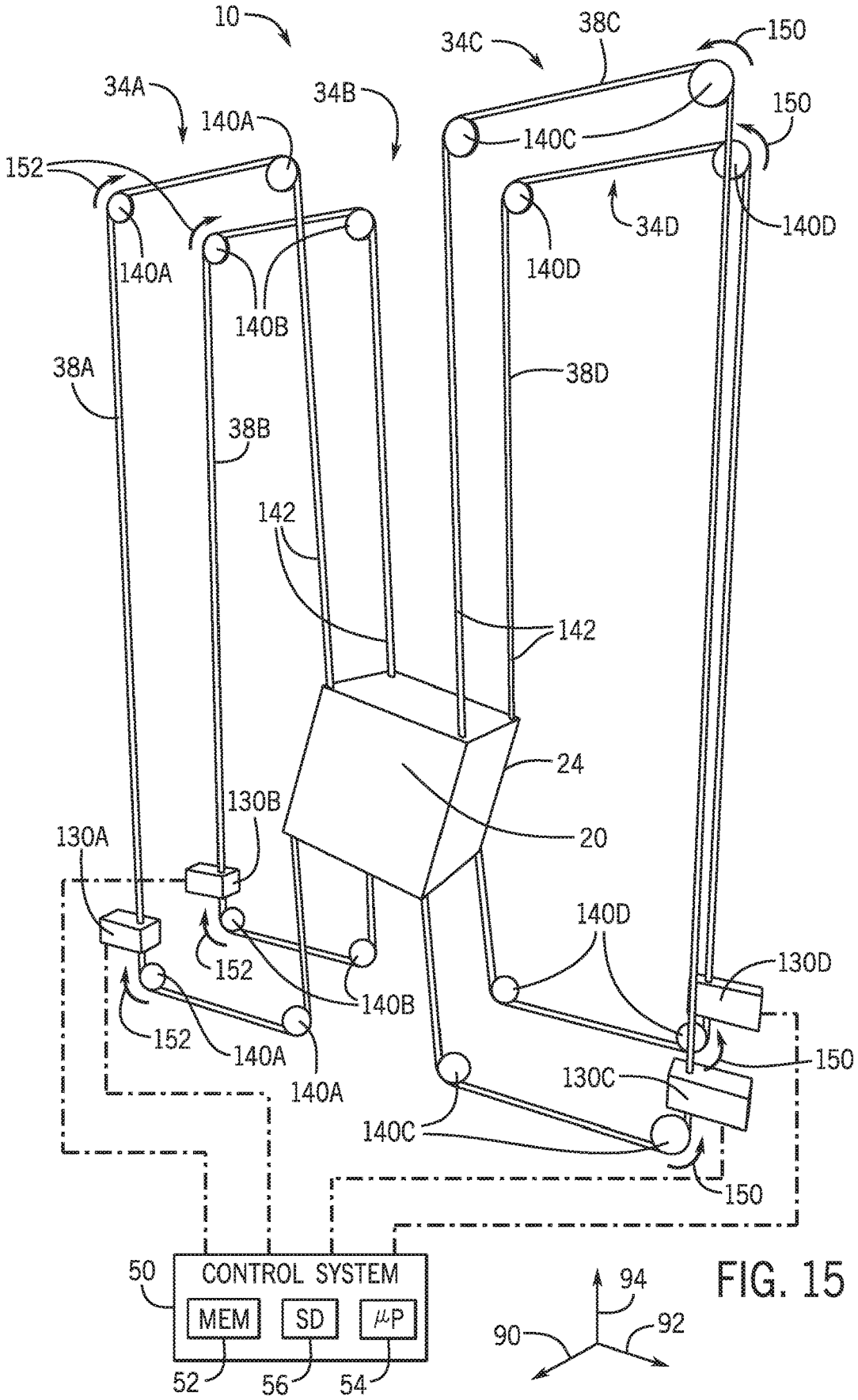
FIG. 15 is a schematic diagram of an embodiment of the four pulley systems of FIG. 12 lowering the carriage of FIG. 3, in accordance with aspects of the present disclosure.

To further help illustrate, FIG. 15 is a schematic diagram of an embodiment of the four pulley systems 34 of FIG. 12 lowering the carriage 24 of FIG. 3, in accordance with aspects of the present disclosure. As illustrated, the carriage 24 may be lowered in response to the control system 50 instructing the first and second motors 30A, 30B to cause the first and second sets of winches 140A, 140B to rotate along the second rotational direction 152 and instructing the third and fourth motors 30C, 30D to cause the third and fourth sets of winches 140C, 140D to rotate along the first rotational direction 150. Similarly, the carriage 24 may be lowered, in response to the control system 50 instructing the motors 30 to cause the portion 142 of the pulley cables 38 to displace downwardly.

Figure 16:
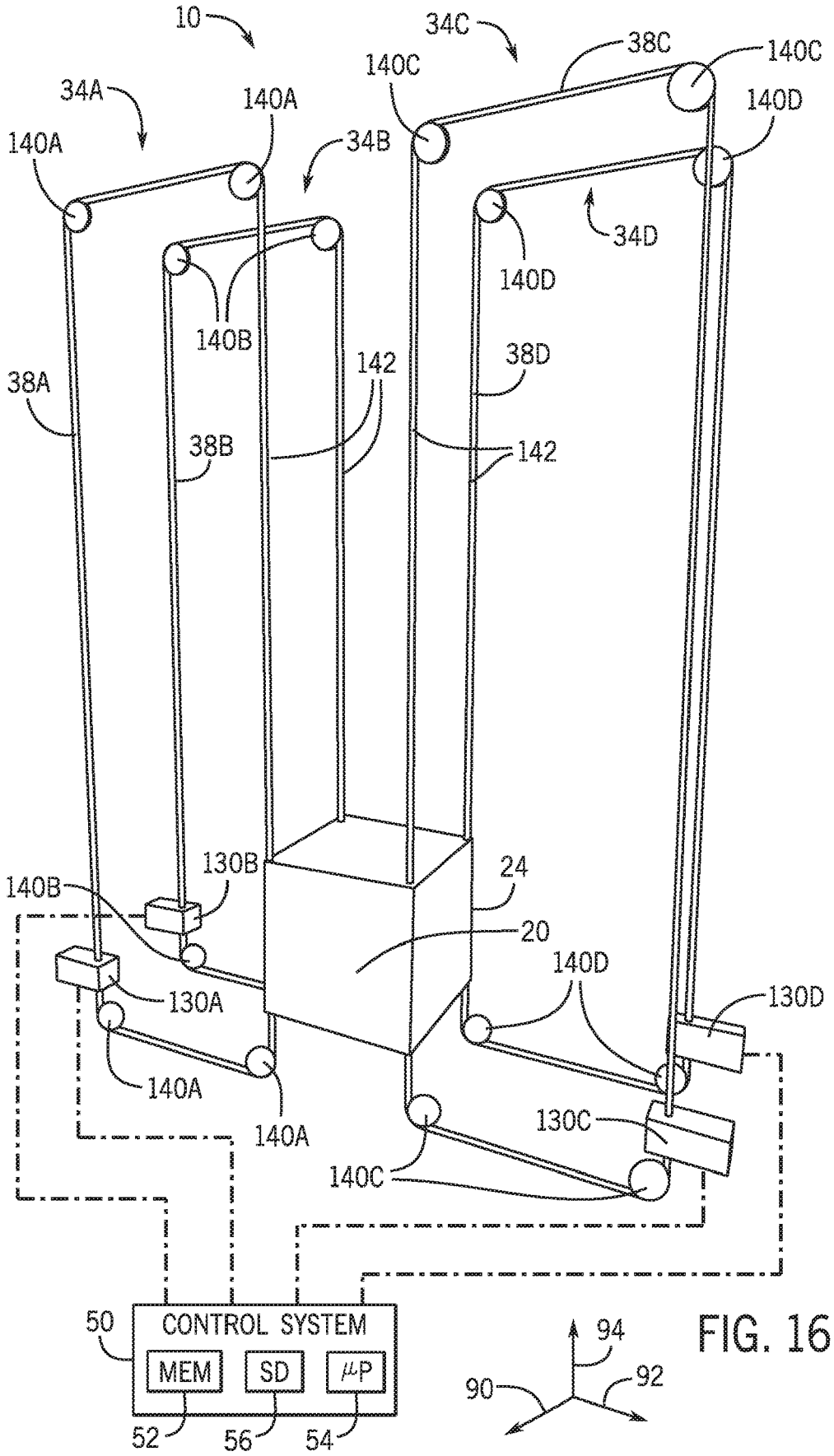
FIG. 16 is a schematic diagram of an embodiment of the four pulley systems of FIG. 12 stabilizing the carriage of FIG. 3, in accordance with aspects of the present disclosure.

As may be appreciated, when the pulley cables 38 are displaced at the same rate and/or when the winches 140 rotate at the same rate, the carriage 24 may vertically translate without substantial rotation about the longitudinal, lateral, and vertical axis 90, 92, 94. To help illustrate this vertical translation of the carriage 24, FIG. 16 is a schematic diagram of an embodiment of the four pulley systems 34 of FIG. 12 stabilizing the carriage 24 of FIG. 3, in accordance with aspects of the present disclosure.

While only certain features of the disclosed embodiments have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A ride system to control ride vehicle motion, the ride system comprising:

a carriage configured to receive and secure a ride vehicle; and a plurality of pulley systems drivingly coupled to the carriage and configured to cooperatively transport the carriage between a first engaged position with a first ride path and a second engaged position with a second ride path, each pulley system of the plurality of pulley systems comprising:

a pulley;

a pulley cable engaged with the pulley and attached to a respective portion of the carriage; and a motor drivingly coupled to the pulley to drive pulley motion and pulley cable motion, and thereby cause the respective portion of the carriage to displace in accordance with the pulley motion and the pulley cable motion, wherein each pulley system of the plurality of pulley systems is configured to independently displace the respective portion of the carriage relative to another portion of the carriage.

2. The ride system of claim 1, wherein the plurality of pulley systems is coupled to at least four points on the carriage to control motion of the carriage in a predetermined manner.

3. The ride system of claim 1, comprising a control system communicatively coupled to the plurality of pulley systems, wherein the control system is configured to actuate the motor of each pulley system of the plurality of pulley systems to drive the corresponding pulley motion and the corresponding pulley cable motion.

4. The ride system of claim 3, wherein the control system comprises control circuitry configured to:

receive an indication that the ride vehicle is at a target position;

instruct a securing device of the carriage to secure the ride vehicle to the carriage at the target position;

actuate the motor of at least one pulley system of the plurality of pulley systems, thereby controlling the ride vehicle motion, in response to determining that the securing device is securing the ride vehicle to the carriage; and disengage the securing device to allow egression of the ride vehicle out from the carriage.

5. The ride system of claim 1, wherein the ride vehicle is configured to decelerate along the first ride path onto the carriage, and wherein the ride vehicle is configured to egress out from the carriage onto the second ride path.

6. The ride system of claim 1, wherein the first ride path is on a level different than the second ride path.

7. The ride system of claim 1, wherein causing the respective portion of the carriage to displace comprises displacing a contact point between the pulley cable and the carriage to achieve a vertical displacement, a roll motion, a pitch motion, or any combination thereof, of the carriage.

8. The ride system of claim 1, wherein the pulley cable of each pulley system of the plurality of pulley systems is a closed-loop pulley cable.

9. The ride system of claim 1, wherein the pulley cable of each pulley system of the plurality of pulley systems is an open-loop pulley cable.

10. The ride system of claim 1, wherein the pulley cable of each pulley system of the plurality of pulley systems extends through a height of the carriage.

11. The ride system of claim 1, wherein the carriage is removably coupled from a platform assembly, wherein the platform assembly comprises a securing mechanism configured to disengage the carriage from the platform assembly, wherein the platform assembly is configured to vertically displace between a first position corresponding to the first engaged position and a second position corresponding to the second engaged position.

12. A method of controlling multi-dimensional ride vehicle motion, the method comprising:

instructing, via a controller, a securing mechanism on a platform assembly to disengage from a carriage housing a ride vehicle received from a first ride path, wherein disengaging the platform assembly from the carriage enables the carriage to freely move relative to the platform assembly;

instructing, via the controller, a plurality of pulley systems to control carriage motion relative to the platform assembly, wherein each pulley system of the plurality of pulley systems is configured to couple to a corresponding portion on the platform assembly or the carriage, wherein actuating the plurality of pulley systems comprises causing each pulley system of the plurality of pulley systems to independently displace the corresponding portion on the platform assembly or the carriage;

instructing, via the controller, a motor of the platform assembly to vertically transport the platform assembly from a first position coupled to the first ride path to a second position coupled to a second ride path, wherein the platform assembly further defines the first ride path while in the first position, and wherein the platform assembly further defines the second ride path while in the second position; and instructing, via the controller, the plurality of pulley systems to position the carriage on the platform assembly to enable the ride vehicle to travel along the second ride path.

13. The method of claim 12, comprising instructing a securing device to secure the ride vehicle to the carriage prior to instructing the plurality of pulley systems to control the carriage motion.

14. The method of claim 12, wherein the securing mechanism is disengaged in response to determining that the ride vehicle is secured to the carriage, wherein instructing the plurality of pulley systems to control the carriage motion comprises vertically displacing a pulley cable of each pulley system of the plurality of pulley systems to displace the corresponding portion of the carriage drivingly coupled to the pulley cable.

15. The method of claim 12, comprising instructing the platform assembly to retract or fold to avoid a travel path of the carriage while the plurality of pulley systems control the carriage motion.

16. The method of claim 12, wherein actuating the plurality of pulley systems to control the carriage motion comprises driving vertical motion of the ride vehicle while reducing roll motion, pitch motion, and yaw motion.

17. A ride system comprising:

a platform assembly, comprising a platform base configured to extend along a ride path, wherein the platform base comprises one or more alignment pins configured to mate with corresponding openings on a carriage to removably couple the carriage to the platform base, wherein the carriage is configured to house and secure a ride vehicle;

a first pulley cable coupled to the carriage at a first portion;

a second pulley cable coupled to the carriage at a second portion; and a first motor coupled to the first pulley cable and a second motor coupled to the second pulley cable, wherein the first motor and the second motor are independently actuatable to independently displace the carriage at the first portion, the second portion, or both, wherein the first motor and the second motor are configured to independently actuate to vertically transport the carriage from a first position associated with a first ride path to a second position associated with a second ride path wherein the platform assembly further defines the first ride path while in the first position, and wherein the platform assembly further defines the second ride path while in the second position.

18. The ride system of claim 17, wherein the platform assembly comprises a back stabilizer configured to be level with a top of a floor of the carriage to facilitate egression of the ride vehicle out of the carriage and onto the first ride path or the second ride path.

19. The ride system of claim 18, wherein the egression of the ride vehicle comprises the ride vehicle traveling from the floor of the carriage, onto the back stabilizer, and onto the first ride path or the second ride path.

20. The ride system of claim 17, comprising a control system communicatively coupled to the platform assembly, the first motor, and the second motor, wherein the control system comprises processing circuitry and memory circuitry storing instructions thereon configured to be executed by the processing circuitry, wherein the instructions are configured to cause the processing circuitry to instruct the first motor to displace the first pulley cable or the second motor to displace the second pulley cable, thereby driving platform assembly motion of the platform assembly.

21. The ride system of claim 17, wherein the platform assembly comprises a plurality of rollers configured to rotate to facilitate the vertical transportation of the platform assembly.

* * * * *